US009273896B2

(12) United States Patent
Sao et al.

(10) Patent No.: US 9,273,896 B2
(45) Date of Patent: Mar. 1, 2016

(54) OUTDOOR UNIT OF REFRIGERATING APPARATUS

(75) Inventors: Tadashi Sao, Osaka (JP); Mikio Kagawa, Osaka (JP); Shigeki Kamitani, Osaka (JP); Fumiaki Koike, Osaka (JP); Yusuke Nakagawa, Osaka (JP); Tomohisa Takeuchi, Osaka (JP); Katsutoshi Sakurai, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 232 days.

(21) Appl. No.: 14/113,503

(22) PCT Filed: May 17, 2012

(86) PCT No.: PCT/JP2012/003241

§ 371 (c)(1), (2), (4) Date: Oct. 23, 2013

(87) PCT Pub. No.: WO2012/160788

PCT Pub. Date: Nov. 29, 2012

(65) Prior Publication Data

US 2014/0047857 A1 Feb. 20, 2014

(30) Foreign Application Priority Data

May 20, 2011 (JP) ..... 2011-114215

(51) Int. Cl.

| | |
|---|---|
| ***F24F 1/20*** | (2011.01) |
| ***F24F 1/22*** | (2011.01) |
| ***F24F 1/24*** | (2011.01) |
| ***F25D 23/00*** | (2006.01) |

(Continued)

(52) U.S. Cl.
CPC ..... *F25D 23/003* (2013.01); *F24F 1/22* (2013.01); *F24F 1/24* (2013.01); *F24F 1/38* (2013.01); *F24F 1/50* (2013.01)

(58) Field of Classification Search
CPC ..... F24F 1/38; F24F 1/46; F24F 1/48
See application file for complete search history.

(56) References Cited

U.S. PATENT DOCUMENTS

| | | | | |
|---|---|---|---|---|
| 4,723,419 A * | 2/1988 | Kessler | F24F 1/38 165/145 |
| 5,294,195 A * | 3/1994 | Amr | F24F 1/18 165/122 |
| 6,470,699 B1 * | 10/2002 | Okuda et al. | 62/259.2 |

(Continued)

FOREIGN PATENT DOCUMENTS

| | | |
|---|---|---|
| CN | 101576291 A | 11/2009 |
| EP | 1 684 022 A1 | 7/2006 |

(Continued)

OTHER PUBLICATIONS

International Search Report issued in PCT/JP2012/003241, dated Aug. 21, 2012.

*Primary Examiner* — Mohammad M Ali
*Assistant Examiner* — Erik Mendoza-Wilkenfel
(74) *Attorney, Agent, or Firm* — Birch, Stewart, Kolach & Birch, LLP

(57) ABSTRACT

In an outdoor unit, an electric component unit includes an inlet part which communicates with an outlet side of an air blower and through which air on the outlet side flows into the electric component unit, and an outlet part which communicates with an inlet side of the air blower and through which air flows out from the electric component unit.

9 Claims, 18 Drawing Sheets

(51) Int. Cl.
*F24F 1/50* (2011.01)
*F24F 1/38* (2011.01)

(56) References Cited

U.S. PATENT DOCUMENTS

| | | | | |
|---|---|---|---|---|
| 2003/0217563 | A1* | 11/2003 | Wendt et al. | 62/298 |
| 2009/0007580 | A1* | 1/2009 | Sakashita et al. | 62/259.1 |
| 2009/0081940 | A1 | 3/2009 | Jang et al. | |
| 2009/0133423 | A1* | 5/2009 | Jang | F24F 1/22 62/259.2 |
| 2009/0137197 | A1* | 5/2009 | Jang et al. | 454/184 |

FOREIGN PATENT DOCUMENTS

| | | | |
|---|---|---|---|
| EP | 2 040 008 | A2 | 3/2009 |
| EP | 2 762 792 | A1 | 8/2014 |
| JP | 55-121183 | U | 8/1980 |
| JP | 5-26476 | A | 2/1993 |
| JP | 2000-161717 | A | 6/2000 |
| JP | 2003-254565 | A | 9/2003 |
| JP | 2004-156872 | A | 6/2004 |
| JP | 2007-198684 | A | 8/2007 |
| JP | 2007-218534 | A | 8/2007 |
| JP | 2008-128496 | A | 6/2008 |
| JP | 2009-79870 | A | 4/2009 |
| JP | 2011-7407 | A | 1/2011 |
| JP | 2011-099577 | A | 5/2011 |
| JP | 2011-137610 | A | 7/2011 |
| JP | 2011-153806 | A | 8/2011 |
| JP | 2011-220654 | A | 11/2011 |
| JP | 2013-7560 | A | 1/2013 |
| WO | WO 2008/047820 | A1 | 4/2008 |

* cited by examiner

OUTDOOR UNIT OF REFRIGERATING APPARATUS

TECHNICAL FIELD

The present disclosure relates to a cooling unit for an electric component(s) provided in an electric component unit.

BACKGROUND ART

Conventionally, separate type air conditioning apparatuses each including an indoor unit and an outdoor unit have been widely used. In the outdoor unit, electric elements such as an air blower and a compressor are arranged in a casing, and an electric component unit in which electric components such as a control board configured to control the electric elements are accommodated is arranged.

In operation of the air conditioning apparatus, the electric component(s) accommodated in the electric component unit generates heat. Such heat generation may increase the temperature of atmosphere inside the electric component unit, resulting in, e.g., damage of the electric component(s). Thus, as in the Patent Document 1, the electric component(s) is cooled in such a manner that an opening or a slit is formed at a side surface of the electric component unit placed inside the casing to ensure an air passage inside the electric component unit.

In Patent Document 1, since air is discharged to the outside of the casing by the air blower, the pressure of air inside the casing is pressure (i.e., negative pressure) lower than atmospheric pressure. Moreover, the electric component unit is arranged inside the casing in which a negative pressure space is formed. In the electric component unit, an airflow is formed by using a pressure difference between air in proximity to the air blower and air distant from the air blower.

CITATION LIST

Patent Document

PATENT DOCUMENT 1: Japanese Unexamined Patent Publication No. 2007-218534

SUMMARY OF THE INVENTION

Technical Problem

However, since the electric component unit is arranged inside the casing in which the negative pressure space is formed, the pressure difference between air in proximity to the air blower and air distant from the air blower is decreased. Accordingly, the volume of air flowing through the electric component unit is decreased. This results in a disadvantage that the electric component(s) cannot be sufficiently cooled.

The present disclosure has been made in view of the foregoing, and aims to increase the volume of air flowing through an electric component unit to sufficiently cool an electric component(s) provided in the electric component unit.

Solution to the Problem

A first aspect of the invention is intended for an outdoor unit of a refrigerating apparatus including a casing in which an outdoor heat exchanger (30), an air blower (40) configured to blow air to an outside of the casing (20), and an electric component unit (60) in which an electric component (70) is accommodated are arranged. The electric component unit (60) includes an inlet part (61) which communicates with an outlet side of the air blower (40) and through which air on the outlet side flows into the electric component unit (60), and an outlet part (62) which communicates with an inlet side of the air blower (40) and through which air flows out from the electric component unit (60).

In the first aspect of the invention, the outdoor heat exchanger (30), the air blower (40), and the electric component unit (60) are arranged inside the casing (20).

In the electric component unit (60), the inlet part (61) communicating with the outlet side of the air blower (40) and the outlet part (62) communicating with the inlet side of the air blower (40) are provided. Air on the outlet side of the air blower (40) flows into the electric component unit (60) through the inlet part (61). Then, the taken air flows out from the electric component unit (60) to the inlet side of the air blower (40) through the outlet part (62).

When air is discharged from the air blower (40), the pressure of air on the inlet side of the air blower (40) in the casing (20) is pressure (i.e., negative pressure) lower than atmospheric pressure. On the other hand, the pressure of air on the outlet side of the air blower (40) is pressure (i.e., positive pressure) higher than the atmospheric pressure.

Due to a pressure difference between air on the outlet side of the air blower (40) and air on the inlet side of the air blower (40), air on the outlet side of the air blower (40) flows into the electric component unit (60) through the inlet part (61) thereof. The taken air passes through the electric component unit (60), and then flows out to the inlet side of the air blower (40) through the outlet part (62).

A second aspect of the invention is intended for the outdoor unit of the first aspect of the invention, in which the casing (20) has a side surface formed with an air inlet port (25), and the outdoor heat exchanger (30) is arranged so as to face the air inlet port (25), the air blower (40) includes a fan (41) and a bell mouth (43) provided so as to surround an outer periphery of the fan (41), and is arranged above the air inlet port (25) in the casing (20) such that air is blown upward, and an electric component unit (60) positioned at a periphery of the bell mouth (43) is arranged in the casing (20).

In the second aspect of the invention, the air inlet port (25) is formed at the side surface of the casing (20). In the casing (20), the outdoor heat exchanger (30) is arranged so as to face the air inlet port (25). Moreover, in the casing (20), the air blower (40) is arranged above the air inlet port (25). The air blower (40) includes the fan (41) and the bell mouth (43). The bell mouth (43) is arranged so as to surround the outer periphery of the fan (41).

Air taken into the casing (20) through the air inlet port (25) by rotation of the fan (41) exchanges heat in the outdoor heat exchanger (30). Then, the air passes through the bell mouth (43), and is discharged to the outside of the casing (20).

In the casing (20), the electric component unit (60) is arranged at the periphery of the bell mouth (43). Thus, an inner space of the casing (20) below the fan (41) and the bell mouth (43) is expanded.

A third aspect of the invention is the outdoor unit of the first aspect of the invention, in which the electric component unit (60) is arranged at a position at which at least part of the electric component unit (60) overlaps with the bell mouth (43) in a height direction and a lower end part of the electric component unit (60) is above the outdoor heat exchanger (30).

In the third aspect of the invention, the electric component unit (60) is arranged at such a position that at least part of the electric component unit (60) overlaps with the bell mouth (43) in the height direction. Moreover, the electric component unit (60) is arranged at such a position that the lower end part thereof is above the outdoor heat exchanger (30).

A fourth aspect of the invention is intended for the outdoor unit of the second or third aspect of the invention, in which, in the casing (20), a stay (20*a*, 20*d*) configured to support a bottom part of the electric component unit (60) is provided between a first chamber (2*b*) which is formed on an upper side inside the casing (20) and in which the air blower (40) and the electric component unit (60) are arranged and a second chamber (2*a*) which is formed on a lower side inside the casing (20) and in which the outdoor heat exchanger (30) is arranged.

In the fourth aspect of the invention, the first chamber (2*b*) on the upper side and the second chamber (2*a*) below the first chamber (2*b*) are formed in the casing (20). In the first chamber (2*b*), the air blower (40) and the electric component unit (60) are arranged. In the second chamber (2*a*), the outdoor heat exchanger (30) is arranged. In the casing (20), the stay (20*a*, 20*d*) is provided between the first chamber (2*b*) and the second chamber (2*a*). The stay (20*a*, 20*d*) supports the bottom part of the electric component unit (60).

A fifth aspect of the invention is the outdoor unit of the fourth aspect of the invention, in which the outlet part (62) is formed in the bottom part of the electric component unit (60), and an air port (28) configured to guide air flowing out through the outlet part (62) to the second chamber (2*a*) is formed in the stay (20*a*, 20*d*).

In the fifth aspect of the invention, the outlet part (62) is formed in the bottom part of the electric component unit (60). Moreover, the air port (28) is formed in the stay (20*a*, 20*d*).

When the air blower (40) blows air, the pressure of air in the second chamber (2*a*) of the casing (20) is pressure (i.e., negative pressure) lower than atmospheric pressure. On the other hand, the pressure of air on the outlet side of the air blower (40) is pressure (i.e., positive pressure) higher than the atmospheric pressure.

Due to a pressure difference between air in the first chamber (2*b*) and air in the second chamber (2*a*), air in the first chamber (2*b*) of the casing (20) flows into the electric component unit (60) through the inlet part (61) thereof. The taken air passes through the inside of the electric component unit (60), and then flows out through the outlet part (62). The discharged air flows into the second chamber (2*a*) of the casing (20) through the air port (28) formed in the stay (20*a*, 20*d*).

A sixth aspect of the invention is intended for the outdoor unit of the fourth aspect of the invention, in which a wire opening (29) through which an electric wire extending from the electric component unit (60) passes is formed in the stay (20*a*, 20*d*).

In the sixth aspect of the invention, the wire opening (29) is formed in the stay (20*a*, 20*d*). The wire opening (29) allows the electric wire extending from the electric component unit (60) to pass therethrough.

A seventh aspect of the invention is intended for the outdoor unit of the fifth or sixth aspect of the invention, in which the outlet part (62) of the electric component unit (60) and the air port (28) of the stay (20*a*, 20*d*) are arranged so as to be displaced from each other in a horizontal direction.

In the seventh aspect of the invention, the outlet part (62) of the electric component unit (60) and the air port (28) of the stay (20*a*, 20*d*) are arranged so as to be displaced from each other in the horizontal direction. That is, as viewed from the above, openings of the outlet part (62) and the air port (28) do not overlap with each other. For example, even if moisture in the second chamber (2*a*) enters the first chamber (2*b*) through the air port (28), the moisture is less likely to reach the inside of the electric component unit (60) through the outlet part (62) because of displacement of the outlet part (62) and the air port (28) in the horizontal direction.

An eighth aspect of the invention is intended for the outdoor unit of any one of the fourth to seventh aspects of the invention, in which the electric component unit (60) is configured to be drawable to an outside of the casing (20), and an outer shape of the electric component unit (60) is a tapered shape in which the electric component unit (60) becomes narrower from a front to a rear in a drawing direction.

In the eighth aspect of the invention, the electric component unit (60) is configured to be drawable to the outside of the casing (20). Moreover, the outer shape of the electric component unit (60) is in such a tapered shape that the electric component unit (60) becomes narrower from the front to the rear in the drawing direction. Thus, the electric component unit (60) can be easily pulled out from the casing (20).

A ninth aspect of the invention is intended for the outdoor unit of any one of the fourth to eighth aspects of the invention, in which the electric component unit (60) is formed such that an inward-facing surface thereof is along an outer periphery of the bell mouth (43).

In the ninth aspect of the invention, the inward-facing surface of the electric component unit (60) is formed along the outer periphery of the bell mouth (43). Thus, the electric component unit (60) can be easily placed at the periphery of the bell mouth (43).

Advantages of the Invention

According to the first aspect of the invention, since the outlet part (62) communicating with the inlet side of the air blower (40) and the inlet part (61) communicating with the outlet side of the air blower (40) are provided in the electric component unit (60), the pressure difference between air at an entrance of the inlet part (61) of the electric component unit (60) and air at an exit of the outlet part (62) of the electric component unit (60) can be increased. This increases the volume of air passing through the electric component unit (60). As a result, the electric component (70) provided inside the electric component unit (60) can be sufficiently cooled.

In the second and third aspects of the invention, the electric component unit (60) is arranged at the periphery of the bell mouth (43) to expand the space below the bell mouth (43). Thus, maintenance of elements arranged below the bell mouth (43) in the casing (20) can be performed without detachment of the electric component unit (60) from the casing (20).

Elements such as a compressor (5*a*) can be arranged below the bell mouth (43) in the casing (20). Thus, the size of the outdoor unit of the refrigerating apparatus can be reduced.

According to the fourth aspect of the invention, since the stay (20*a*, 20*d*) is provided, the bottom part of the electric component unit (60) can be supported. Thus, the electric component unit (60) can be stably held in the casing (20).

According to the fifth aspect of the invention, since the outlet part (62) is formed in the bottom part of the electric component unit (60) and the air port (28) is formed in the stay (20*a*, 20*d*), air flowing out through the outlet part (62) of the electric component unit (60) can be sent to the second chamber (2*a*) of the casing (20) through the air port (28).

According to the sixth aspect of the invention, since the wire opening (29) is formed, the electric wire extending from the electric component unit (60) can be drawn toward the second chamber (2*a*). Thus, an electric component(s) of the element(s) placed below the air blower (40) in the casing (20) can be connected to the electric component unit (60) through the wire.

According to the seventh aspect of the invention, since the outlet part (62) of the electric component unit (60) and the air port (28) of the stay (20*a*, 20*d*) are arranged such that the openings of the outlet part (62) and the air port (28) do not overlap with each other as viewed from the above, moisture is less likely to reach the inside of the electric component unit (60) even if the moisture flows from the second chamber (2*a*) to the first chamber (2*b*) through the air port (28).

According to the eighth aspect of the invention, since the electric component unit (60) is configured to be drawable to the outside of the casing (20) and is formed in such a tapered shape that the electric component unit (60) becomes narrower from the front to the rear in the drawing direction, the electric component unit (60) can be easily drawn out from the casing (20). Thus, maintainability of the electric component unit (60) can be improved.

According to the ninth aspect of the invention, since the electric component unit (60) is formed such that the inward-facing surface thereof is along the outer periphery of the bell mouth (43), the electric component unit (60) can be easily placed at the periphery of the bell mouth (43). Elements such as a compressor can be arranged below the bell mouth (43) in the casing (20). Thus, the size of the outdoor unit of the refrigerating apparatus can be reduced.

DESCRIPTION OF EMBODIMENTS

Embodiments of the present disclosure will be described below in detail with reference to drawings.

First Embodiment of the Invention

Figure 1:
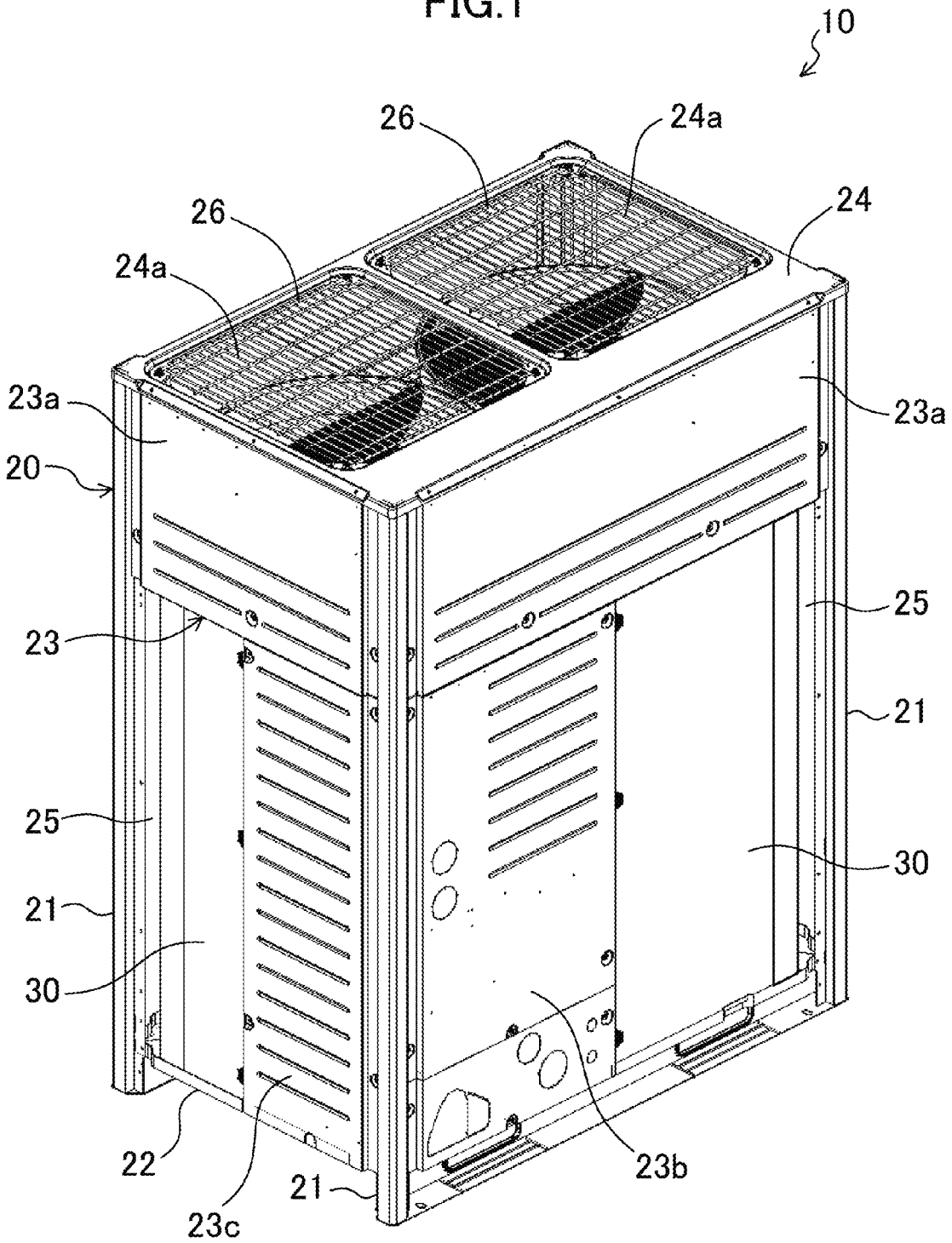
FIG. 1 is a perspective view of an outdoor unit of a first embodiment.
Figure 2:
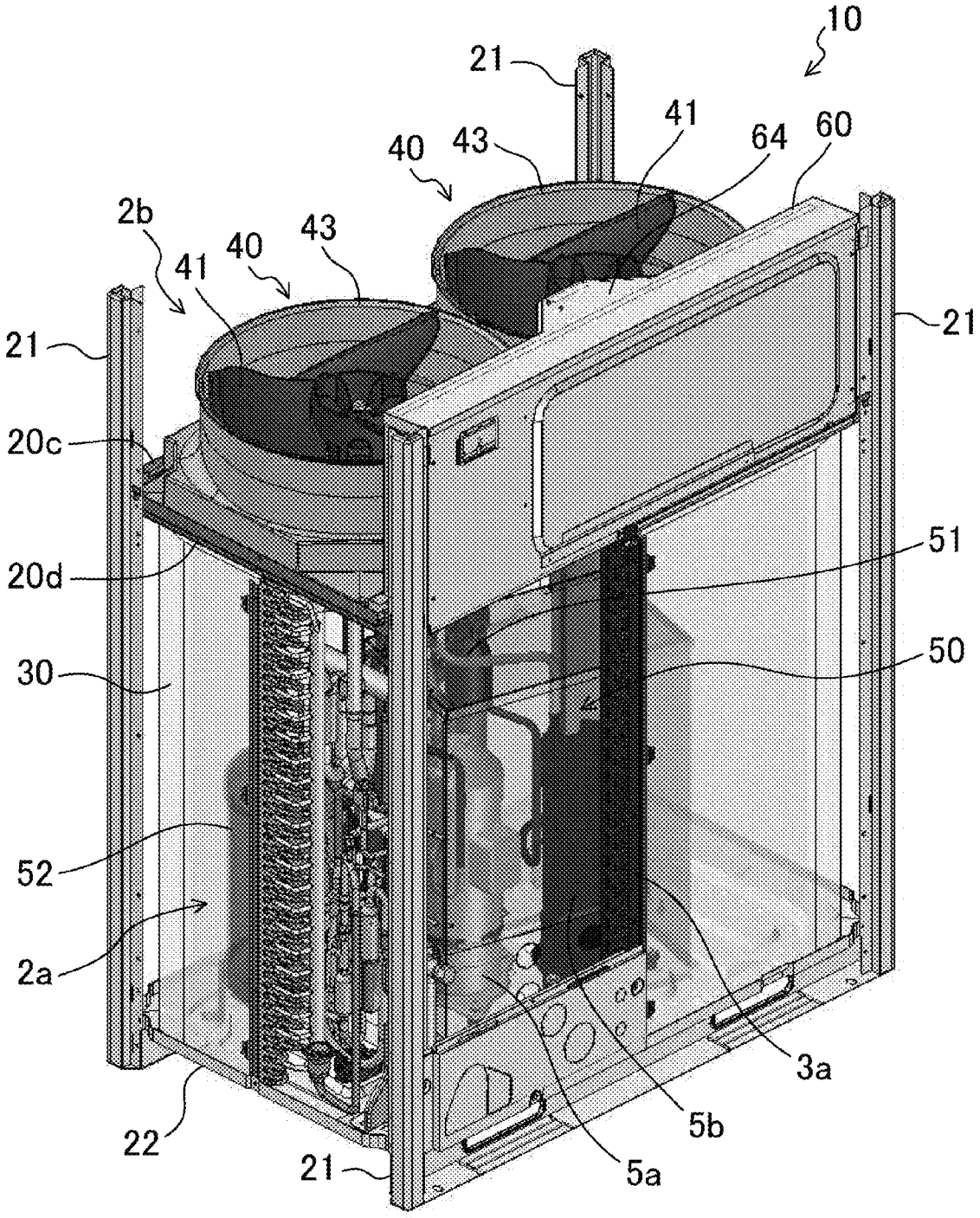
FIG. 2 is a partially-omitted perspective view of the outdoor unit of the first embodiment.
Figure 3:
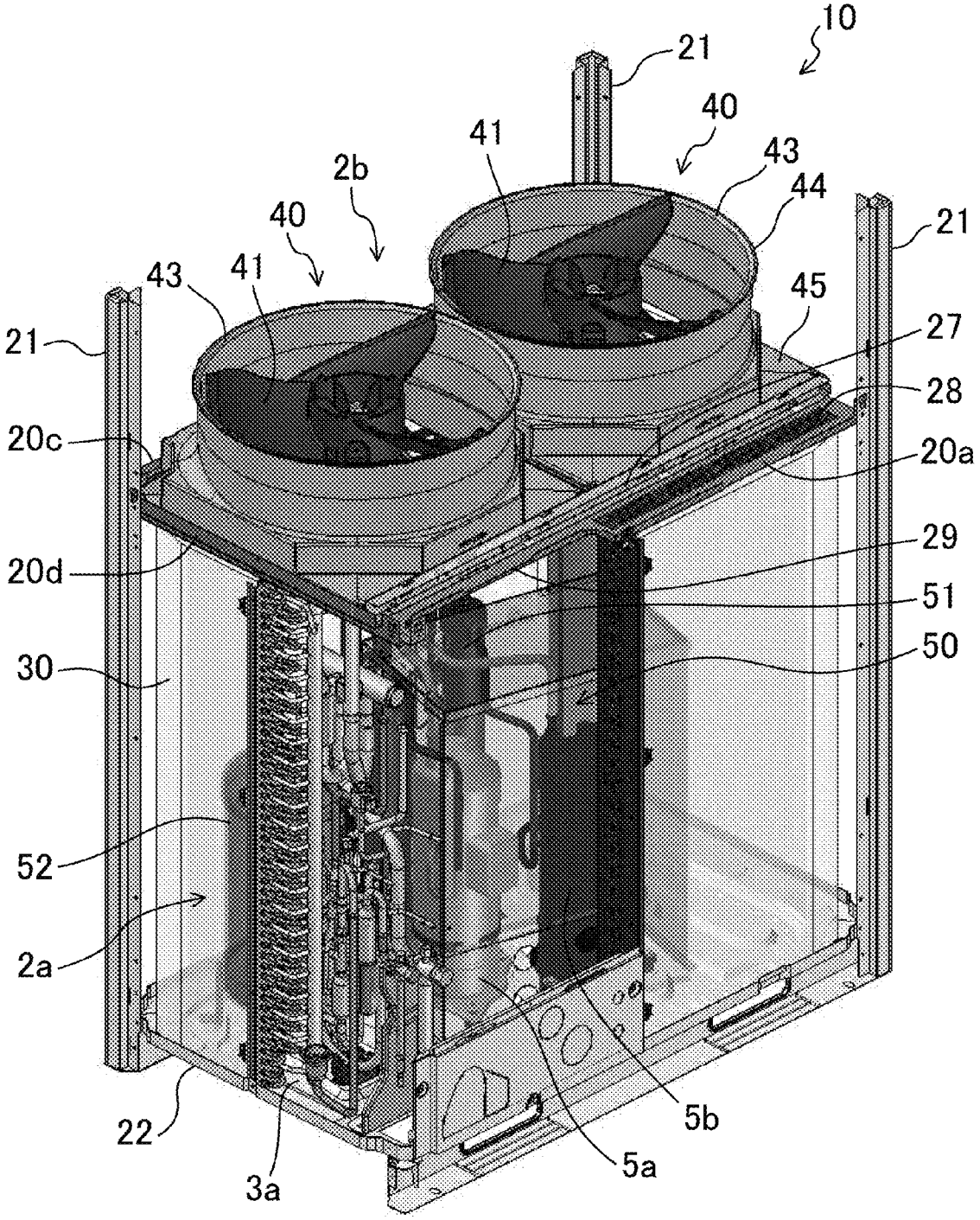
FIG. 3 is a partially-omitted perspective view of the outdoor unit of the first embodiment.

Referring to FIGS. 1-3, an outdoor unit (10) of a first embodiment is used for an air conditioning apparatus which is a refrigerating apparatus. Although not shown in the figure, an indoor unit is connected to the outdoor unit (10) to perform a vapor compression refrigeration cycle.

The outdoor unit (10) is placed at, e.g., a roof of a building. The outdoor unit (10) includes a casing (20), an outdoor heat exchanger (30), outdoor fans (40), and a compression mechanism (50).

The casing (20) is formed in a rectangular shape as viewed in a plane. The casing (20) includes four supports (21), a bottom frame (22), side panels (23), and a top panel (24).

The supports (21) are provided respectively at four corners of the casing (20), and the bottom frame (22) is fixed to lower parts of the supports (21).

The side panels (23) include upper panels (23*a*) forming an upper half of the casing (20) on four sides thereof, a front panel (23*b*) forming a left half of a front surface of the casing (20) in a lower half thereof, and a lateral side panel (23*c*) forming a front half of a left side surface of the casing (20) in the lower half thereof. At the sides of the casing (20), inlet ports (25) are formed respectively at a right half of the front surface of the casing (20) in the lower half thereof, a right side surface of the casing (20) in the lower half thereof, a rear surface of the casing (20) in the lower half thereof, and a rear half of the left side surface of the casing (20) in the lower half thereof. The inlet port (25) serves as an air inlet port of the present disclosure.

The top panel (24) is fixed to upper ends of the supports (21), and outlet ports (26) are formed in the top panel (24). The top panel (24) includes grills (24*a*) each covering a corresponding one of the outlet ports (26).

The outdoor heat exchanger (30) is a fin-and-tube heat exchanger, and is configured to exchange heat between outdoor air and refrigerant. The outdoor heat exchanger (30) is provided in an upright attitude, and is configured as a bent heat exchanger extending along all side surfaces of the casing (20). Predetermined openings (3*a*) are formed between side edges of the outdoor heat exchanger (30) so as to sandwich a front left corner of the casing (20). That is, in the casing (20), the front panel (23*b*) and the lateral side panel (23*c*) are provided corresponding respectively to the openings (3*a*) of the outdoor heat exchanger (30).

The compression mechanism (50), an oil separator (51), and an accumulator (52) are attached to the bottom frame (22), and the compression mechanism (50) includes two compressors (5*a*, 5*b*).

In the casing (20), a horizontally-extending front stay (20*a*), horizontally-extending side stays (20*b*, 20*d*), and a horizontally-extending rear stay (20*c*) are positioned between a lower space (2*a*) in which the outdoor heat exchanger (30) is accommodated and an upper space (2*b*) in which the outdoor fans (40) are accommodated, and are attached to the four sides of the casing (20). Note that the front stay (20*a*) will be described later. The upper space (2*b*) serves as a first chamber of the present disclosure, and the lower space (2*a*) serves as a second chamber of the present disclosure.

The pressure of air flowing on an outlet side of the outdoor fan (40) in the upper space (2*b*) is pressure (i.e., positive pressure) higher than atmospheric pressure. On the other hand, the lower space (2*a*) is a space where air on an inlet side of the outdoor fan (40) flows. The pressure of air flowing through the lower space (2*a*) is pressure (i.e., negative pressure) lower than the atmospheric pressure.

The outdoor fans (40) include two outdoor fans (40). Each of the outdoor fans (40) includes a fan body (41) which is a propeller fan, a fan motor (not shown in the figure), and a bell mouth (43). The fan body (41) and the fan motor are attached to the front stay (20*a*) and the rear stay (20*c*). Note that the outdoor fan (40) serves as an air blower of the present disclosure. Moreover, the fan body (41) serves as a fan of the present disclosure.

The bell mouth (43) includes a body (44) formed in a cylindrical shape, and a base (45) formed in a substantially rectangular plate shape as viewed in a plane.

The base (45) is, at four outer circumferential sides thereof, attached to the stays (20*a*-20*d*). An air passage opening having the substantially same diameter as that of the body (44) is formed at the center of the base (45).

An electric component unit (60) in which, e.g., an electric component configured to control the compression mechanism (50) etc. is accommodated is attached to the casing (20).

The electric component unit (60) is arranged above a front part of the outdoor heat exchanger (30) in proximity to an upper end of the outdoor heat exchanger (30). Moreover, the electric component unit (60) is provided between the upper panel (23*a*) and each of the bell mouths (43) of the outdoor fans (40). Further, the electric component unit (60) is arranged at such a position that a lower end part of the electric component unit (60) is placed above the outdoor heat exchanger (30) and that part of the electric component unit (60) overlaps with the bell mouths (43) in a height direction.

Figure 4:
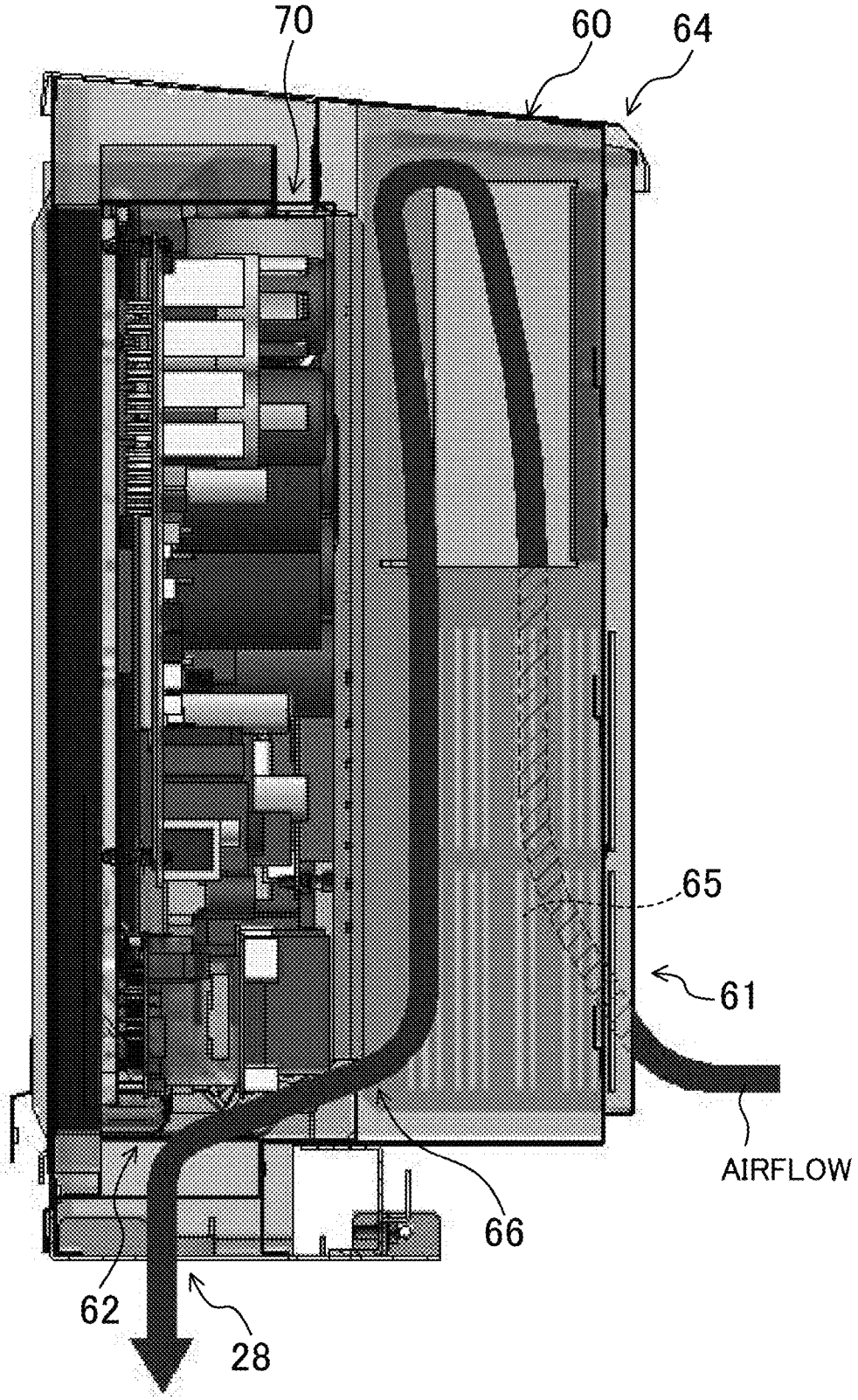
FIG. 4 is a schematic cross-sectional view of an electric component unit of the first embodiment.

Specifically, the electric component unit (60) is, referring to FIGS. 2 and 4, a box formed in a substantially rectangular flat plate shape, and is attached to the casing (20) in the state in which the electric component unit (60) is upwardly supported by the front stay (20*a*). Although not shown in the figure, legs are provided respectively at four corners of a bottom part of the electric component unit (60), and the bottom part of the electric component unit (60) is arranged slightly apart from a surface of the front stay (20*a*).

A protrusion (64) protruding backward is formed at a rear surface of the electric component unit (60). A reactor (71) which is a heat generating element is placed inside the protrusion (64). Moreover, in the electric component unit (60), e.g., a control board (70) configured to control the compressors (5*a*, 5*b*) etc. is accommodated.

An inlet part (61) through which air is taken into the electric component unit (60) and an outlet part (62) through which air is discharged to the outside of the electric component unit (60) are formed in the electric component unit (60).

Openings are formed in the inlet part (61), and the inlet part (61) is formed at the rear surface of the electric component unit (60). The inlet part (61) allows an internal space of the electric component unit (60) and part of the upper space (2*b*) on the outlet side of the outdoor fan (40) to communicate with each other.

Figure 5:
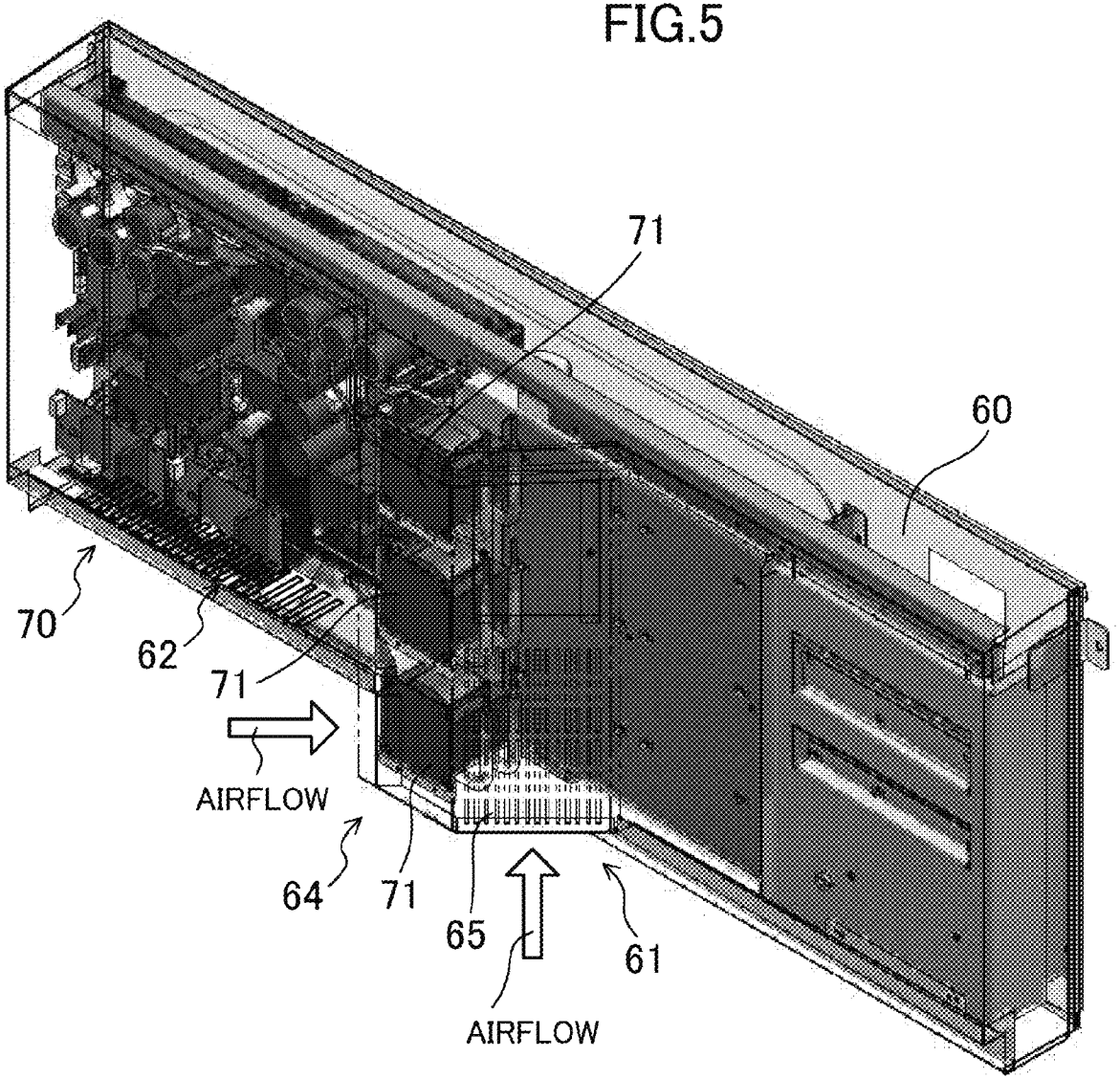
FIG. 5 is a partially-omitted perspective view of the electric component unit of the first embodiment.

Specifically, in the inlet part (61), the followings are formed as illustrated in FIGS. 4 and 5: slits (65) formed in a substantially lower part of the protrusion (64) at the rear surface of the electric component unit (60); and an opening (66) formed in a lower wall part of a body of the electric component unit (60) at the rear surface thereof. The slits (65) serve as an entrance of the inlet part (61), and the opening (66) serves as an exit of the inlet part (61). Thus, the inlet part (61) can be configured to have a labyrinth structure. Consequently, it can be ensured that rainwater entering the casing (20) is prevented from entering the electric component unit (60).

Openings are formed in the outlet part (62), and the outlet part (62) is formed close to a first end of the electric component unit (60) in a longitudinal direction thereof in the bottom part of the electric component unit (60). The outlet part (62) opens to the internal space of the electric component unit (60), and also opens to the front stay (20*a*). Note that a side close to the first end of the electric component unit (60) in the longitudinal direction thereof is a side close to the right as viewed from the front in FIG. 1, and a side close to a second end of the electric component unit (60) in the longitudinal direction thereof is a side close to the left as viewed from the front in FIG. 1.

The front stay (20*a*) is attached to a front side of the casing (20), and serves as a stay of the present disclosure. The front stay (20*a*) is formed in a substantially rectangular flat plate shape as viewed in a plane. The front stay (20*a*) is, at both end parts thereof, attached to two of the supports (21) arranged in a width direction of the casing (20) on the front side thereof, and is held in a horizontal attitude. In the front stay (20*a*), a guide (27), a cutout (29), and slits (28) are formed.

The guide (27) is used for positioning the electric component unit (60) relative to an outer side surface of the bell mouth (43). The guide (27) upwardly protrudes from an upper surface of the front stay (20*a*), and is formed close to a rear end part of the front stay (20*a*) at the upper surface thereof along a longitudinal direction of the front stay (20*a*).

The cutout (29) is configured to guide a wire(s) (harness (es)) extending from the inside of the electric component unit (60) to the lower space (2*a*) and guide a refrigerant pipe(s) to the lower space (2*a*), and serves as a wire opening of the present disclosure. The cutout (29) is formed in such a manner that a substantially-rectangular part of a front end part of the front stay (20*a*) on the side close to the second end of the electric component unit (60) in the longitudinal direction thereof as viewed in a plane is cut out. Note that the refrigerant pipe is formed as a pipe through which refrigerant flows, and is configured to cool, e.g., a heat sink and the control board (70) provided inside the electric component unit (60) in contact therewith.

Each of the slits (28) is an opening through which air flowing out through the outlet part (62) of the electric component unit (60) is guided to the lower space (2*a*), and serves as an air port of the present disclosure. The slits (28) are formed in part of the front end part of the front stay (20*a*) on the side close to the first end of the electric component unit (60) in the longitudinal direction thereof. The slits (28) and the outlet part (62) of the electric component unit (60) are arranged such that the openings of the slits (28) and the openings of the outlet part (62) do not overlap with each other as viewed from the above. That is, the slits (28) and the outlet part (62) of the electric component unit (60) are formed such that the openings of the slits (28) and the openings of the outlet part (62) are displaced from each other in the horizontal direction. Thus, moisture flowing from the lower space (2*a*) to an upper part of the front stay (20*a*) through the slits (28) can be prevented from entering the electric component unit (60) through the outlet part (62).

As described above, the inside of the casing (20) is divided into the upper space (2*b*) and the lower space (2*a*) by the stays (20*a*-20*d*), the bell mouths (43), and the electric component unit (60). Thus, in the casing (20), the upper space (2*b*) is formed at the positive pressure, and the lower space (2*a*) is formed at the negative pressure.

Airflow in Outdoor Unit During Operation

During operation of the outdoor unit (10), the outdoor fans (40) are operated to cause air outside the casing (20) to pass through the inlet ports (25) and the outdoor heat exchanger (30), and then the air is taken into the lower space (2*a*). While passing through the outdoor heat exchanger (30), the air to be taken exchanges heat with refrigerant flowing through the outdoor heat exchanger (30). The air flowing through the lower space (2*a*) flows upward and flows into the upper space (2*b*). Then, the air is sucked into the outdoor fans (40), and then is discharged through the outlet ports (26).

Airflow in Electric Component Unit

During the operation of the outdoor unit (10), the outdoor fans (40) are also operated to form an airflow inside the electric component unit (60).

Specifically, the operation of the outdoor fans (40) causes, referring to FIGS. 4 and 5, the pressure of air on the outlet side of the outdoor fan (40) in the upper space (2*b*) to be positive pressure higher than atmospheric pressure, and, on the other hand, causes the pressure of air in the lower space (2*a*) to be negative pressure lower than the atmospheric pressure.

Due to a pressure difference between air at the entrance of the inlet part (61) of the electric component unit (60) and air at an exit of the outlet part (62) of the electric component unit (60), air on the outlet side of the outdoor fan (40) flows into the protrusion (64) through the slits (65) of the inlet part (61). After the air passes through the protrusion (64) and cools the reactor (71), the air flows into the body of the electric component unit (60) through the opening (66). While flowing downward, the air flowing into the body of the electric component unit (60) cools the control board (70) etc. provided in the electric component unit (60). Then, the air flowing through the electric component unit (60) flows out from the electric component unit (60) through the outlet part (62) of the bottom part of the electric component unit (60).

Next, part of the air flowing to the outside of the electric component unit (60) through the outlet part (62) flows to the lower space (2*a*) through the cutout (29) of the front stay (20*a*), and the remaining part of the air flows to the lower space (2*a*) through the slits (28).

The air flowing out to the lower space (2*a*) is sucked into the outdoor fans (40). Then, the air flows upward, and is discharged to the outside of the casing (20).

Advantages of First Embodiment

According to the first embodiment, since the outlet part (62) communicating with the inlet side of the outdoor fan (40) and the inlet part (61) communicating with the outlet side of the outdoor fan (40) are formed in the electric component unit (60), the pressure difference between air at the entrance of the inlet part (61) of the electric component unit (60) and air at the exit of the outlet part (62) of the electric component unit (60) can be increased. This increases the volume of air flowing through the electric component unit (60). As a result, the control board (70) provided inside the electric component unit (60) can be sufficiently cooled.

Moreover, the electric component unit (60) is arranged at the periphery of the bell mouths (43) to expand the space below the bell mouths (43). Thus, maintenance of elements arranged below the bell mouths (43) in the casing (20) can be performed without detachment of the electric component unit (60) from the casing (20).

Elements such as the compressor (5*a*) can be arranged below the bell mouths (43) in the casing (20). Thus, the size of the outdoor unit (10) of the refrigerating apparatus can be reduced.

Since the front stay (20*a*) is provided, the bottom part of the electric component unit (60) can be supported. Thus, the electric component unit (60) can be stably held in the casing (20).

Since the outlet part (62) is formed in the bottom part of the electric component unit (60) and the slits (28) are formed in the front stay (20*a*), air flowing out through the outlet part (62) of the electric component unit (60) can be sent to the lower space (2*a*) of the casing (20) through the slits (28).

Since the cutout (29) is formed, the electric wire(s) extending from the electric component unit (60) can be drawn toward the lower space (2*a*). Thus, the electric component(s) of the element(s) placed below the outdoor fans (40) in the casing (20) can be connected to the electric component unit (60) through the wire(s).

Since the outlet part (62) of the electric component unit (60) and the slits (28) of the front stay (20*a*) are arranged such that the openings of the outlet part (62) and the openings of the slits (28) do not overlap with each other as viewed from the above, moisture is less likely to reach the inside of the electric component unit (60) even if the moisture flows from the lower space (2*a*) to the upper space (2*b*) through the slits (28).

Second Embodiment of the Invention

Figure 6:
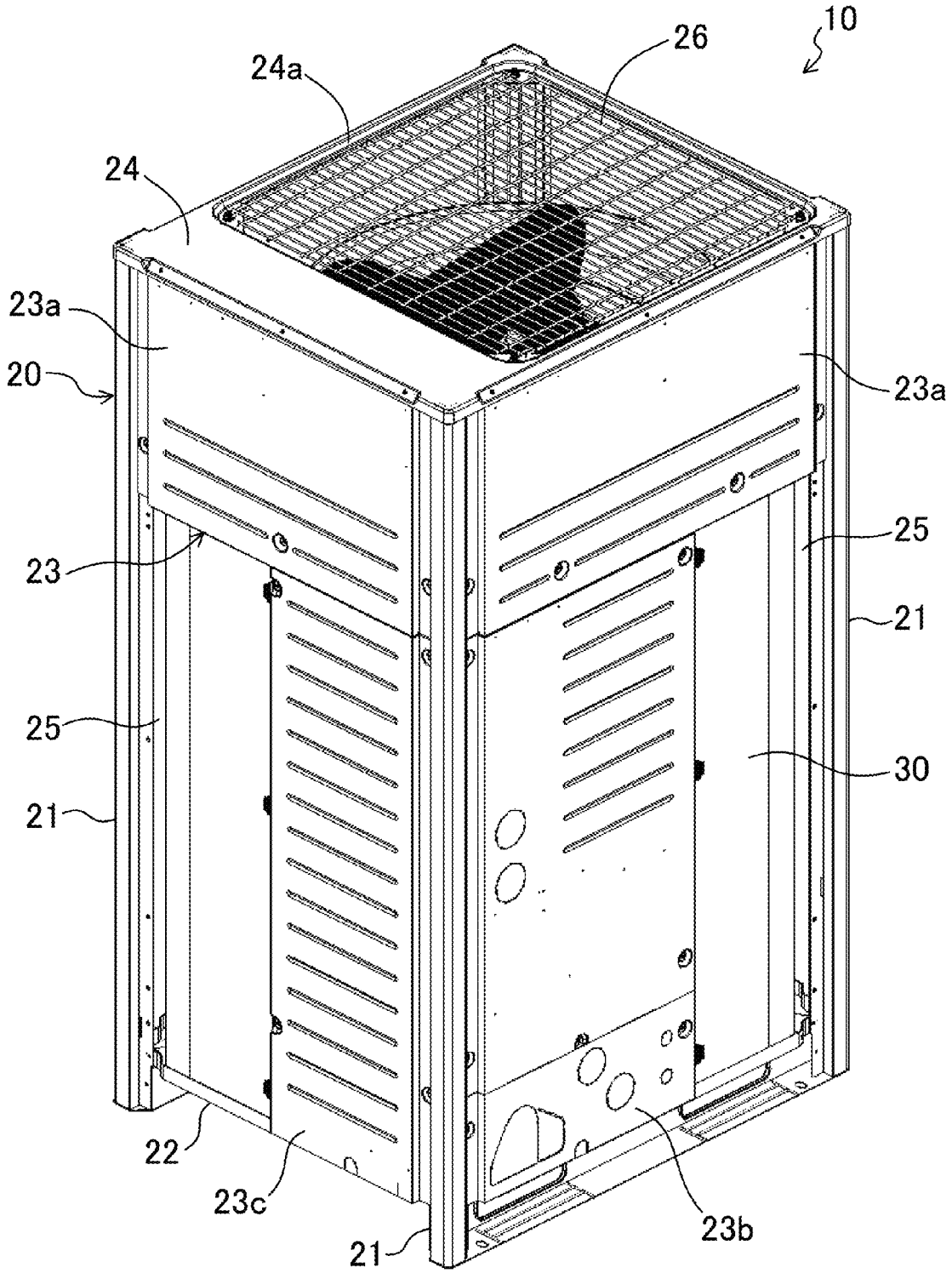
FIG. 6 is a perspective view of an outdoor unit of a second embodiment.
Figure 7:
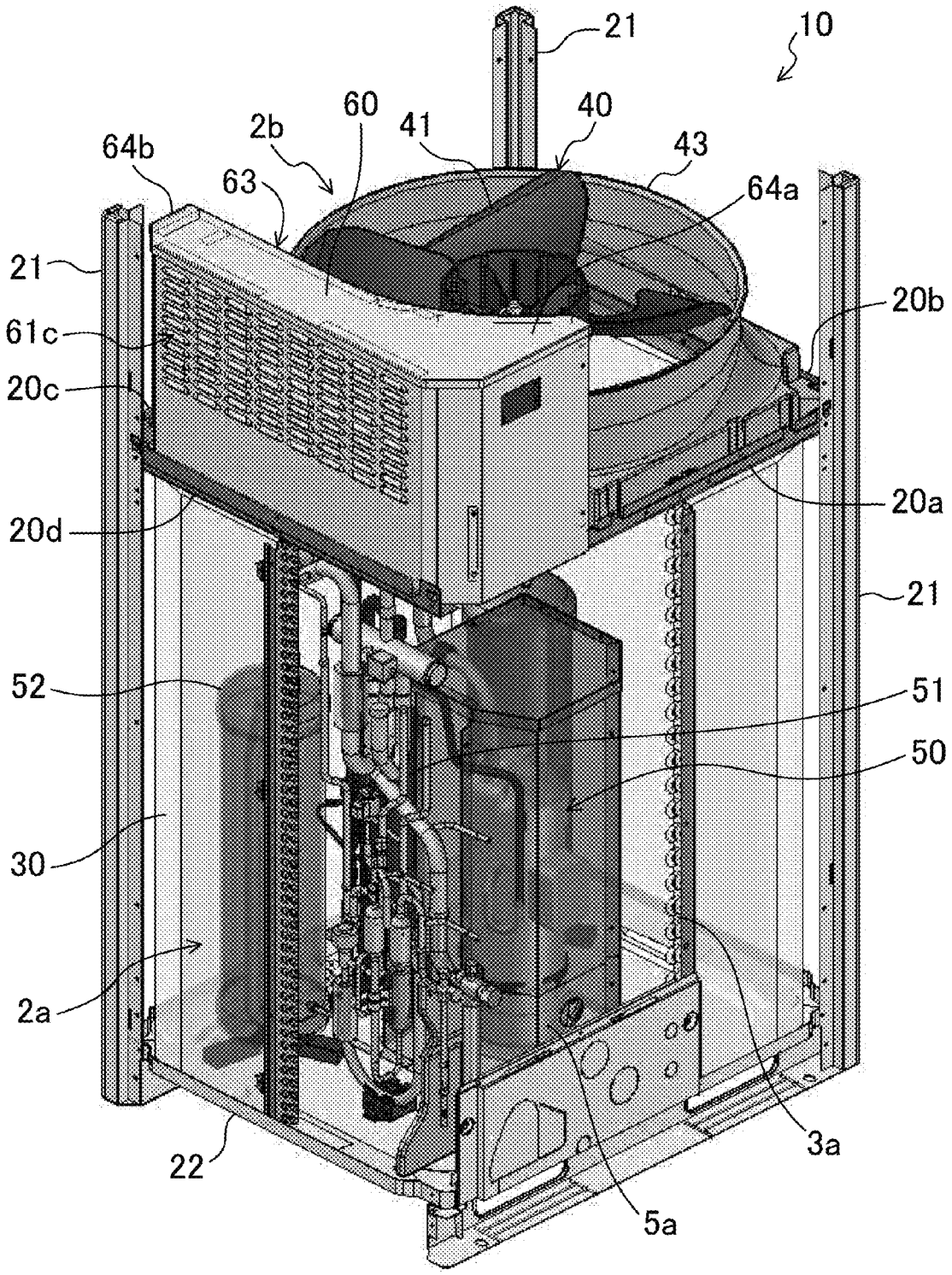
FIG. 7 is a partially-omitted perspective view of the outdoor unit of the second embodiment.
Figure 8:
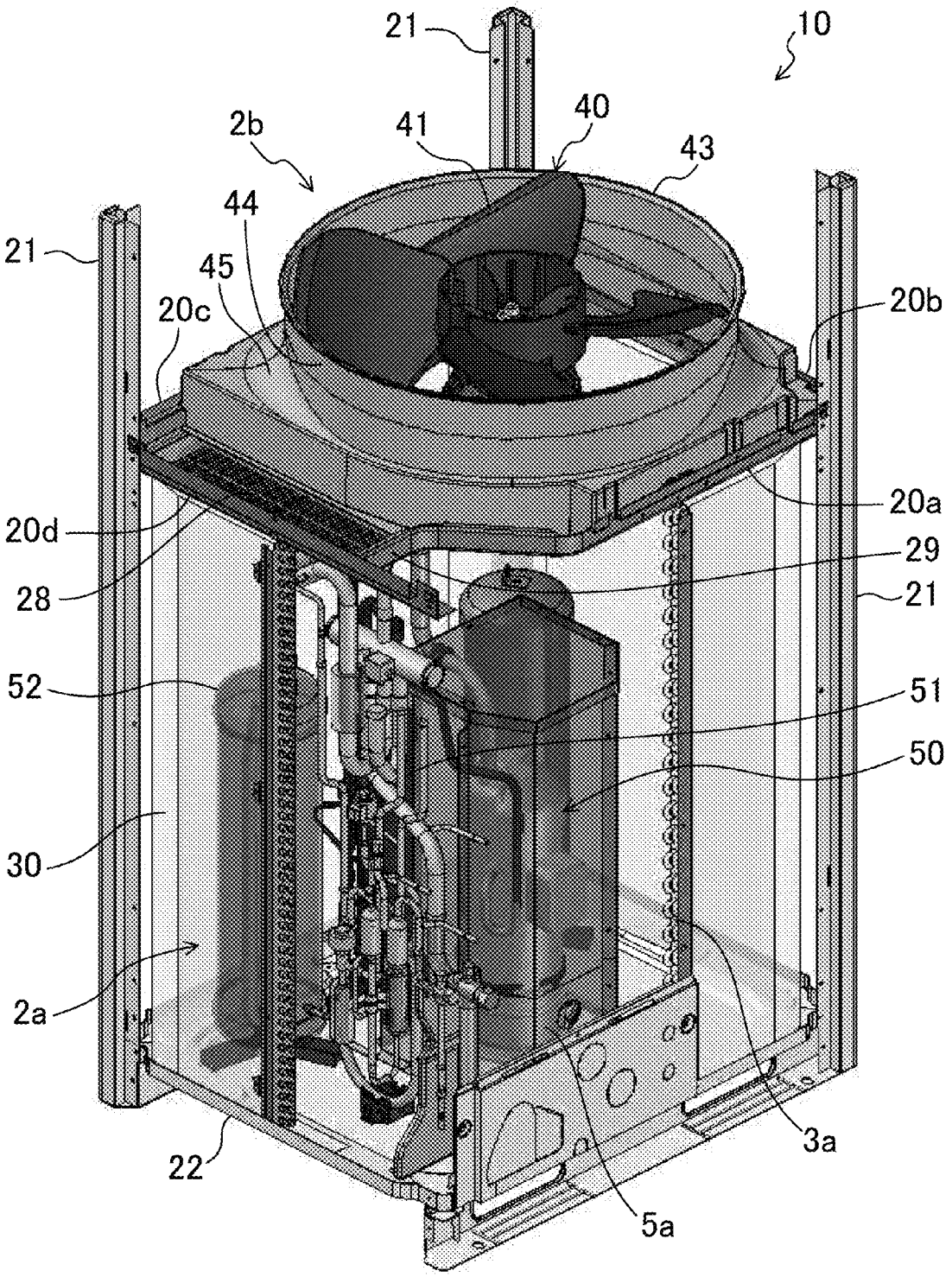
FIG. 8 is a partially-omitted perspective view of the outdoor unit of the second embodiment.

Next, a second embodiment of the present disclosure will be described. Referring to FIGS. 6-8, an outdoor unit (10) of the second embodiment is used for an air conditioning apparatus which is a refrigerating apparatus. Although not shown in the figure, an indoor unit is connected to the outdoor unit (10) to perform a vapor compression refrigeration cycle.

The outdoor unit (10) is placed at, e.g., a roof of a building. The outdoor unit (10) includes a casing (20), an outdoor heat exchanger (30), an outdoor fan (40), and a compression mechanism (50).

The casing (20) is formed in a rectangular shape as viewed in a plane. The casing (20) includes four supports (21), a bottom frame (22), side panels (23), and a top panel (24).

The supports (21) are provided respectively at four corners of the casing (20), and the bottom frame (22) is fixed to lower parts of the supports (21).

The side panels (23) include upper panels (23*a*) forming an upper half of the casing (20) on four sides thereof, a front panel (23*b*) forming a left half of a front surface of the casing (20) in a lower half thereof, and a lateral side panel (23*c*) forming a front half of a left side surface of the casing (20) in the lower half thereof. At the sides of the casing (20), inlet ports (25) are formed respectively at a right half of the front surface of the casing (20) in the lower half thereof, a right side surface of the casing (20) in the lower half thereof, a rear surface of the casing (20) in the lower half thereof, and a rear half of the left side surface of the casing (20) in the lower half thereof.

The top panel (24) is fixed to upper ends of the supports (21), and an outlet port (26) is formed in the top panel (24). The top panel (24) includes a grill (24*a*) covering the outlet port (26).

The outdoor heat exchanger (30) is a fin-and-tube heat exchanger, and is configured to exchange heat between outdoor air and refrigerant. Referring to FIGS. 7 and 8, the outdoor heat exchanger (30) is provided in an upright attitude, and is configured as a bent heat exchanger extending along all side surfaces of the casing (20). Predetermined openings (3*a*) are formed between side edges of the outdoor heat exchanger (30) so as to sandwich a front left corner of the casing (20). That is, in the casing (20), the front panel (23*b*) and the lateral side panel (23*c*) are provided corresponding respectively to the openings (3*a*) of the outdoor heat exchanger (30).

The compression mechanism (50), an oil separator (51), and an accumulator (52) are attached to the bottom frame (22), and the compression mechanism (50) includes a single compressor (5*a*).

In the casing (20), a horizontally-extending front stay (20*a*), a horizontally-extending right stay (20*b*), a horizontally-extending left stay (20*d*), and a horizontally-extending rear stay (20*c*) are positioned between a lower space (2*a*) in which the outdoor heat exchanger (30) is accommodated and an upper space (2*b*) in which the outdoor fan (40) is accommodated, and are attached to the four sides of the casing (20). Note that the left stay (20*d*) will be described later. The upper space (2*b*) serves as a first chamber of the present disclosure, and the lower space (2*a*) serves as a second chamber of the present disclosure.

The pressure of air flowing on an outlet side of the outdoor fan (40) in the upper space (2*b*) is pressure (i.e., positive pressure) higher than atmospheric pressure. On the other hand, the lower space (2*a*) is a space where air on an inlet side of the outdoor fan (40) flows. The pressure of air flowing through the lower space (2*a*) is pressure (i.e., negative pressure) lower than the atmospheric pressure.

The outdoor fan (40) includes a fan body (41) which is a propeller fan, a fan motor, and a bell mouth (43). The fan body (41) and the fan motor are attached to the front stay (20*a*) and the rear stay (20*c*).

The bell mouth (43) includes a body (44) formed in a cylindrical shape, and a base (45) formed in a rectangular plate shape as viewed in a plane.

The base (45) is, at four outer circumferential sides thereof, attached to the stays (20*a*-20*d*). An air passage opening having the substantially same diameter as that of the body (44) is formed at the center of the base (45).

An electric component unit (60) in which, e.g., an electric component configured to control the compression mechanism (50) etc. is accommodated is attached to the casing (20). The electric component unit (60) is arranged on the left stay (20*d*) positioned at the left when viewing the casing (20) from the front, and is also arranged in proximity to an upper end of the outdoor heat exchanger (30). Moreover, the electric component unit (60) is provided between the upper side panel (23*a*) positioned at the left when viewing the casing (20) from the front and the bell mouth (43) of the outdoor fan (40). Further, the electric component unit (60) is arranged at such a position that a lower end part of the electric component unit (60) is placed above the outdoor heat exchanger (30) and that part of the electric component unit (60) overlaps with the bell mouth (43) in a height direction.

Referring to FIGS. 9-12, the electric component unit (60) is formed in a substantially elongated rectangular parallelepiped box shape, and the electric component unit (60) is formed such that the area of a first side surface of the electric component unit (60) is larger than that of a second side surface of the electric component unit (60) opposite to the first side surface. The electric component unit (60) is upwardly supported by the left stay (20*d*), and is arranged along the left periphery of the bell mouth (43). Although not shown in the figure, legs are provided respectively at corners of a bottom part of the electric component unit (60), and the bottom part of the electric component unit (60) is arranged slightly apart from an upper surface of the left stay (20*d*). In the second embodiment, the first side surface is a front surface of the electric component unit (60) in the state in which the electric component unit (60) is placed in the casing (20), and the second side surface is a rear surface (back surface) of the electric component unit (60).

In the electric component unit (60), a first protrusion (64*a*) protruding toward the right as viewed in FIG. 7 is formed at part of the electric component unit (60) close to the first side surface thereof, and a second protrusion (64*b*) protruding backward from part of the electric component unit (60) close to the second side surface thereof is formed. In the first protrusion (64*a*), a reactor (71) which is a heat generating element is placed. Moreover, in a body of the electric component unit (60), e.g., a control board (70) configured to control the compressor (5*a*) etc. is accommodated.

At an inward-facing surface of the electric component unit (60), an arc-shaped recess (63) is, as viewed in a plane, formed along the outer periphery of the bell mouth (43).

In the electric component unit (60), an electric component(s) such as the control board (70) configured to control the compressor (5*a*) etc. is accommodated. Moreover, in the electric component unit (60), first, second, and third inlet parts (61*a*, 61*b*, 61*c*) through each of which air is taken into the electric component unit (60) and an outlet part (62) through which air is discharged to the outside of the electric component unit (60) are provided.

Openings are formed in the first inlet part (61*a*), and the first inlet part (61*a*) is formed in an inner part of the electric component unit (60) close to the first side surface thereof. The first inlet part (61*a*) allows an internal space of the electric component unit (60) and the outlet side of the outdoor fan (40) in the upper space (2*b*) to communicate with each other.

Figure 9:
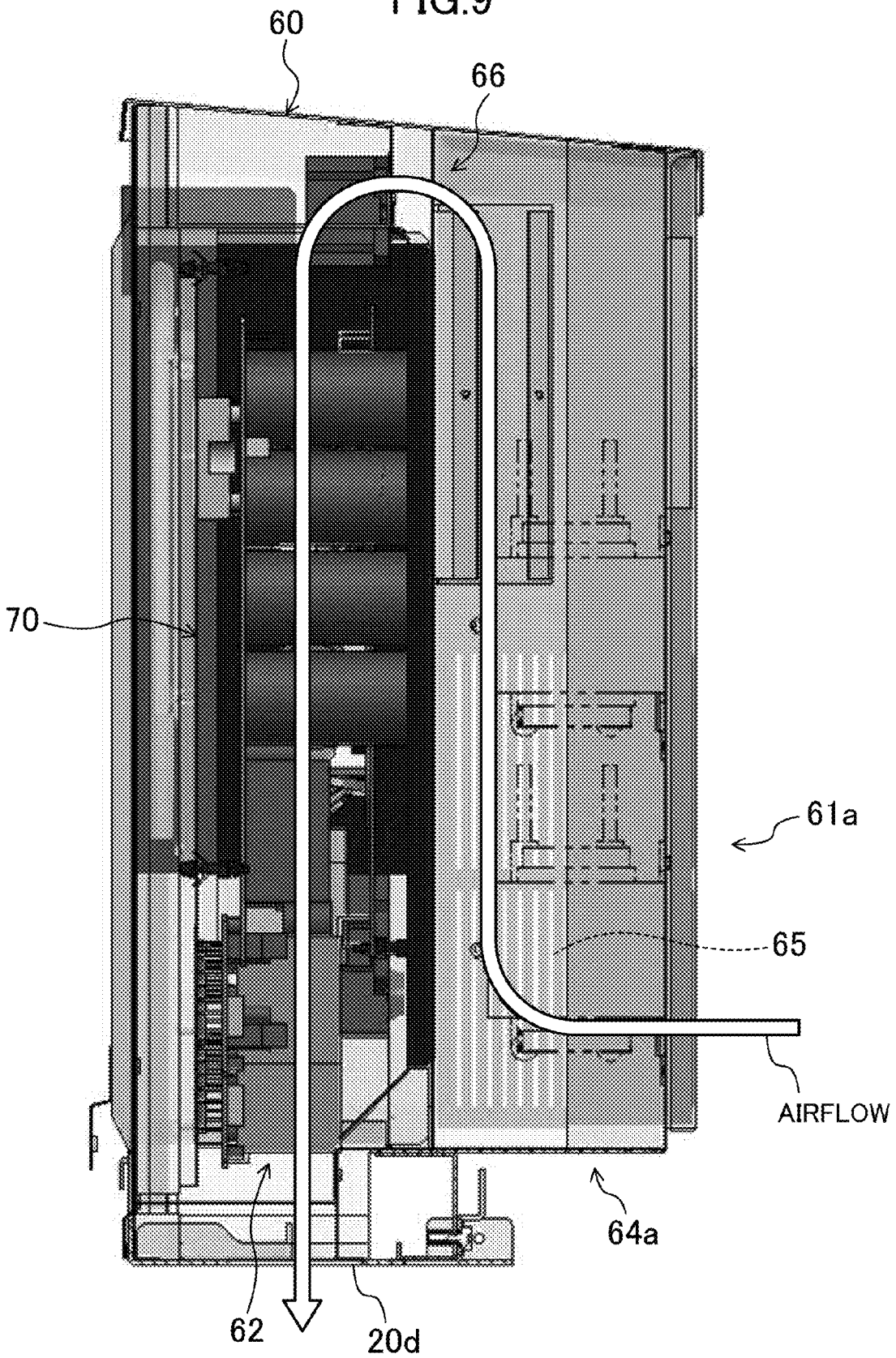
FIG. 9 is a schematic cross-sectional view of an electric component unit of the second embodiment.
Figure 10:
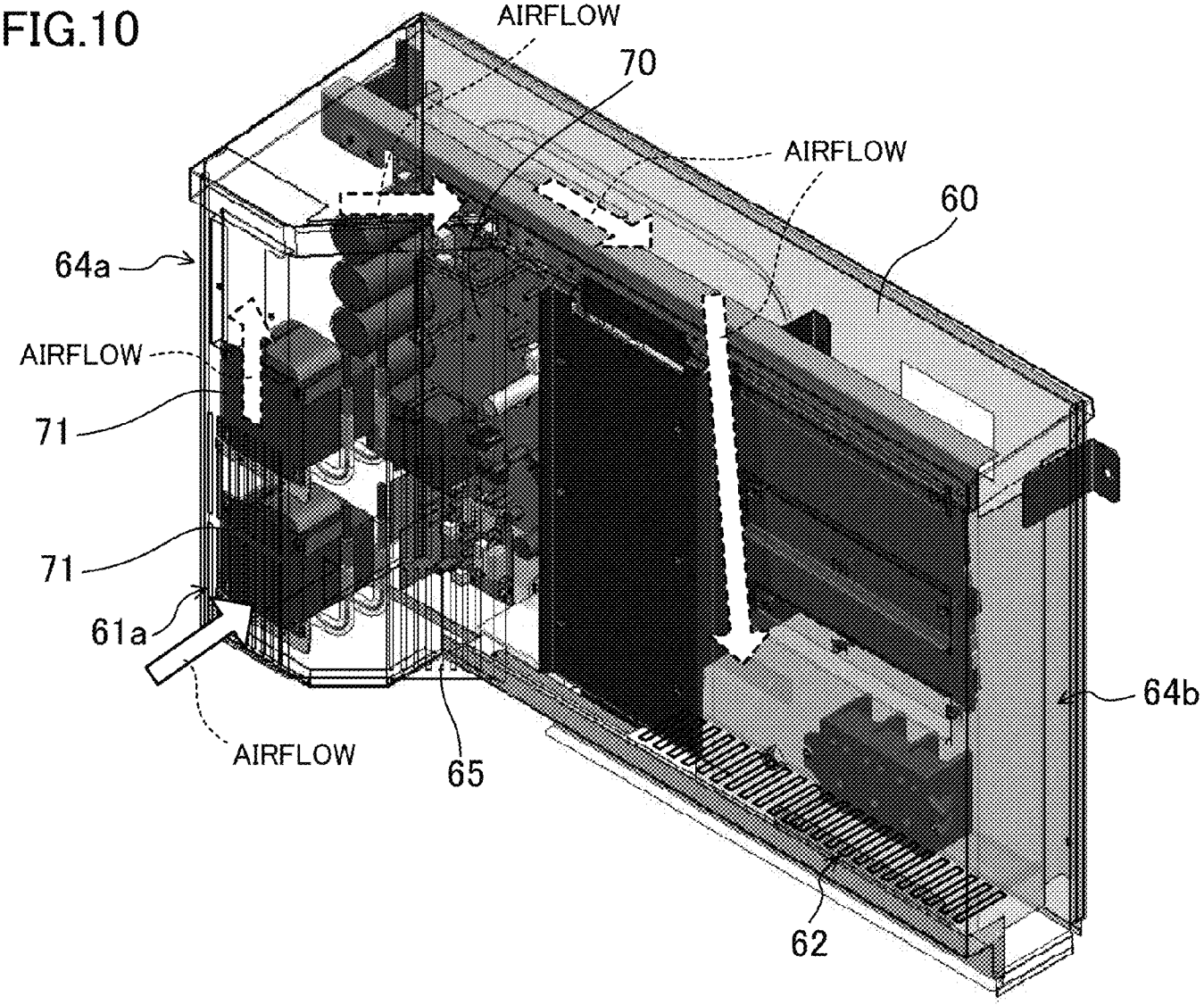
FIG. 10 is a partially-omitted perspective view of the electric component unit of the second embodiment.

Specifically, in the first inlet part (61*a*), the followings are formed as illustrated in FIGS. 9 and 10: slits (65) formed in a lower part of the first protrusion (64*a*) at the side surface of the electric component unit (60); and an opening (66) formed in an upper wall part of the side surface of the body of the electric component unit (60). The slits (65) serve as an entrance of the first inlet part (61*a*), and the opening (66) serves as an exit of the first inlet part (61*a*). Thus, the first inlet part (61*a*) can be configured to have a labyrinth structure. Consequently, it can be ensured that rainwater entering the casing (20) through the outlet port (26) is prevented from entering the electric component unit (60).

Openings are formed in the outlet part (62), and the outlet part (62) is formed close to a rear end of the electric component unit (60) in a longitudinal direction thereof in the bottom part of the electric component unit (60). The outlet part (62) opens to the internal space of the electric component unit (60), and also opens to the left stay (20*d*).

Openings are formed in the second inlet part (61*b*), and the second inlet part (61*b*) is formed in part of the electric component unit (60) close to the second side surface thereof. The second inlet part (61*b*) allows the internal space of the electric component unit (60) and the outlet side of the outdoor fan (40) in the upper space (2*b*) to communicate with each other.

Figure 11:
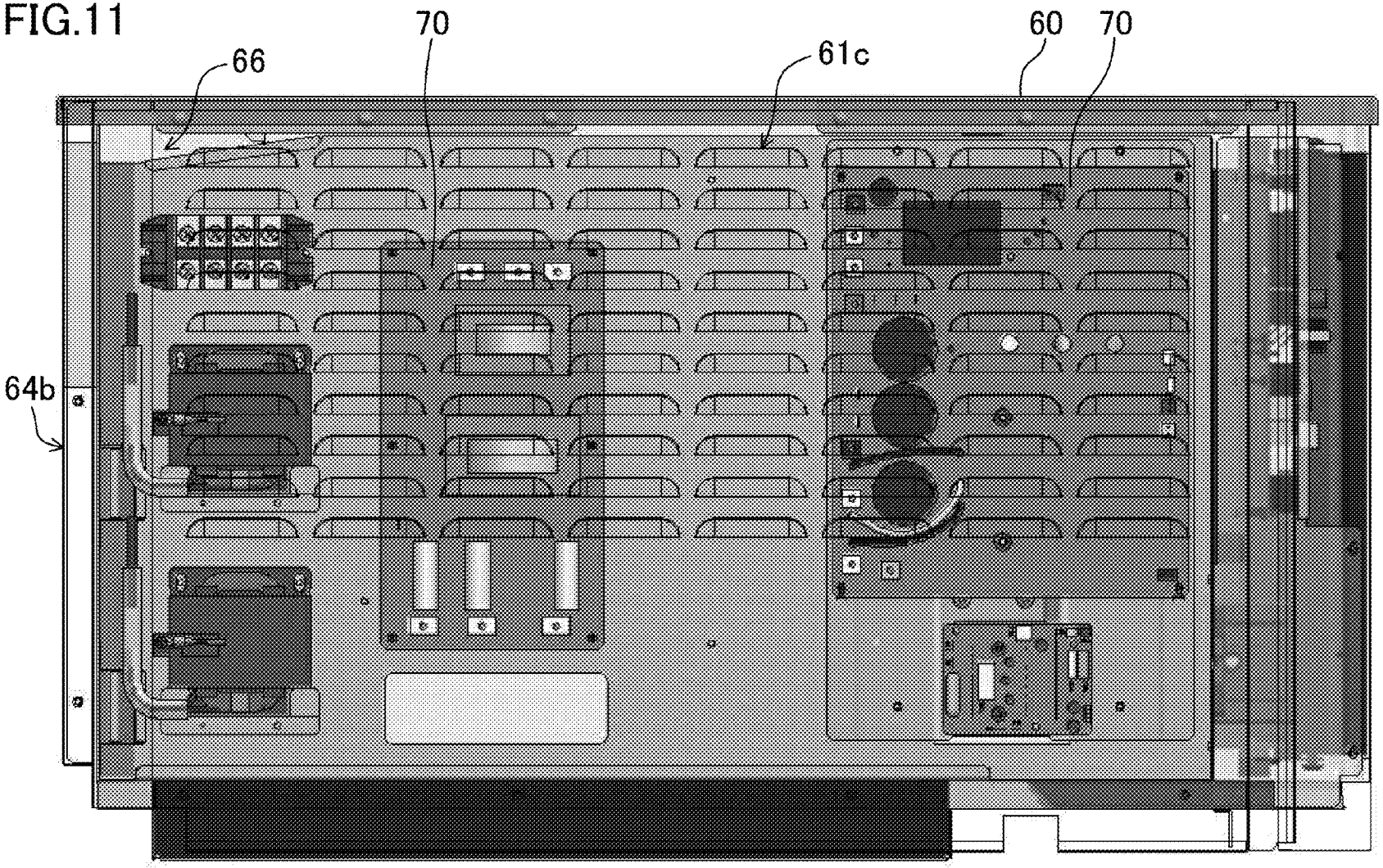
FIG. 11 is a partially-omitted side view of the electric component unit of the first embodiment.
Figure 12:
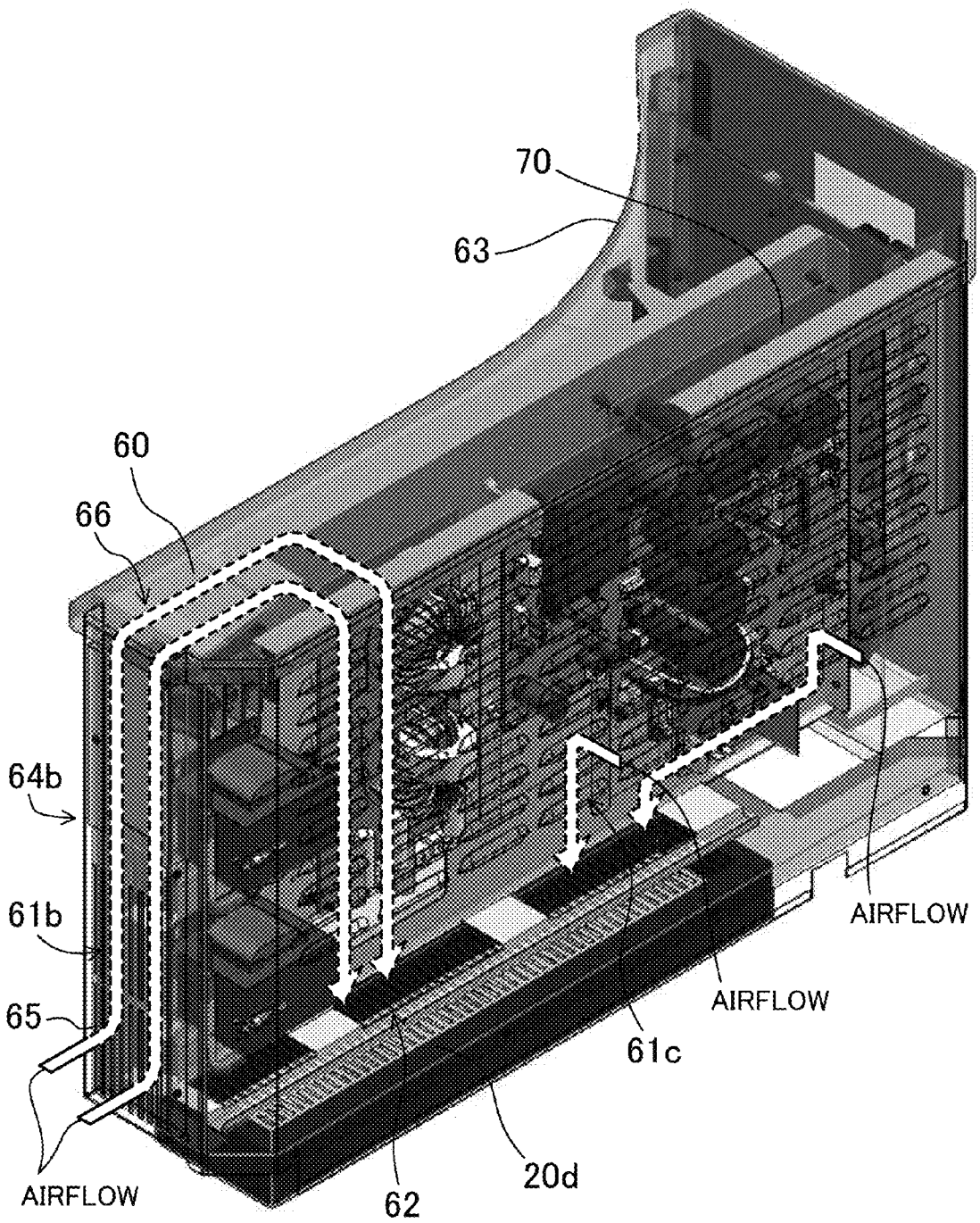
FIG. 12 is a partially-omitted perspective view of the electric component unit of the second embodiment.

Specifically, in the second inlet part (61*b*), the followings are formed as illustrated in FIGS. 11 and 12: slits (65) formed in a lower part of the second protrusion (64*b*) at the second side surface of the electric component unit (60); and an opening (66) formed in part of the body of the electric component unit (60) close to the second side surface thereof. The slits (65) serve as an entrance of the second inlet part (61*b*), and the opening (66) serves as an exit of the second inlet part (61*b*). Thus, the second inlet part (61*b*) can be configured to have a labyrinth structure. Consequently, it can be ensured that rainwater entering the casing (20) through the outlet port (26) is prevented from entering the electric component unit (60).

A plurality of slits are formed in the third inlet part (61*c*), and are formed in a substantially upper part of a left side surface of the electric component unit (60) as viewed in FIG. 7.

The left stay (20*d*) is attached to the left side of the casing (20), and serves as a stay of the present disclosure. The left stay (20*d*) is formed in a substantially rectangular flat plate shape as viewed in an plane. The left stay (20*d*) is held in a horizontal attitude in the state in which end parts of the left stay (20*d*) in a front-rear direction thereof are attached respectively to two of the supports (21) arranged respectively on a front left side and a rear left side of the casing (20). In the left stay (20*d*), a guide (not shown in the figure), and a cutout (29), and slits (28) are formed.

The guide is used for positioning the electric component unit (60) relative to an outer side surface of the bell mouth (43). The guide upwardly protrudes from an upper surface of the left stay (20*d*), and is formed close to a left end part of the left stay (20*d*) at the upper surface thereof along a longitudinal direction of the left stay (20*d*).

The cutout (29) is configured to guide a wire(s) (harness (es)) extending from the inside of the electric component unit (60) to the lower space (2*a*) and guide a refrigerant pipe(s) to the lower space (2*a*), and serves as a wire opening of the present disclosure. The cutout (29) is formed in such a manner that a substantially-rectangular part of the left stay (20*d*) close to a front end of the left stay (20*d*) in the longitudinal direction thereof as viewed in a plane is cut out. Note that the refrigerant pipe is formed as a pipe through which refrigerant flows, and is configured to cool, e.g., a heat sink and the control board (70) provided inside the electric component unit (60) in contact therewith.

Each of the slits (28) is an opening through which air flowing out through the outlet part (62) of the electric component unit (60) is guided to the lower space (2*a*), and serves as an air port of the present disclosure. The slits (28) are formed close to a rear end part of the left stay (20*d*) in the longitudinal direction thereof. The slits (28) and the outlet part (62) of the electric component unit (60) are arranged such that the openings of the slits (28) and the openings of the outlet part (62) do not overlap with each other as viewed from the above. That is, the slits (28) and the outlet part (62) of the electric component unit (60) are arranged such that the openings of the slits (28) and the openings of the outlet part (62) of the electric component unit (60) are displaced from each other in the horizontal direction. Thus, moisture flowing from the lower space (2*a*) to an upper part of the left stay (20*d*) through the slits (28) can be prevented from entering the electric component unit (60) through the outlet part (62).

As described above, the inside of the casing (20) is divided into the upper space (2*b*) and the lower space (2*a*) by the stays (20*a*-20*d*), the bell mouth (43), and the electric component unit (60). Thus, in the casing (20), the upper space (2*b*) is formed at the positive pressure, and the lower space (2*a*) is formed at the negative pressure.

Method for Attaching/Detaching Electric Component Unit

A method for attaching/detaching the electric component unit (60) to/from the casing (20) will be described. When the electric component unit (60) is attached to the casing (20), attachment is performed in such a manner that the electric component unit (60) is pushed from the front to the rear along the left stay (20*d*) in the state in which the upper panel (23*a*) on the front side is detached.

On the other hand, when the electric component unit (60) is detached from the casing (20), detachment is performed in such a manner that the electric component unit (60) is pulled from the rear to the front along the left stay (20*d*) in the state in which the upper panel (23*a*) on the front side is detached.

Airflow in Electric Component Unit

During operation of the outdoor unit (10), the outdoor fan (40) is operated to form an airflow inside the electric component unit (60).

Specifically, the operation of the outdoor fan (40) causes, referring to FIGS. 9-12, the pressure of air on the outlet side of the outdoor fan (40) in the upper space (2*b*) to be positive pressure higher than atmospheric pressure, and, on the other hand, causes the pressure of air in the lower space (2*a*) to be negative pressure lower than the atmospheric pressure.

Due to a pressure difference between air at the entrance of the first inlet part (61*a*) of the electric component unit (60) and air at an exit of the outlet part (62) of the electric component unit (60), air on the outlet side of the outdoor fan (40) flows into the first protrusion (64*a*) of the electric component unit (60) through the first inlet part (61*a*). After the air passes through the first protrusion (64*a*) and cools the reactor (71), the air flows into the body of the electric component unit (60) through the opening (66). While flowing downward, the air flowing into the body of the electric component unit (60) cools the control board (70) etc. provided in the electric component unit (60). Then, the air flowing through the electric component unit (60) flows out from the electric component unit (60) through the outlet part (62) of the bottom part of the electric component unit (60).

Due to a pressure difference between air at the entrance of the second inlet part (61*b*) and air at the exit of the outlet part (62), air on the outlet side of the outdoor fan (40) flows into the second protrusion (64*b*) of the electric component unit (60) through the second inlet part (61*b*). After the air passes through the second protrusion (64*b*), the air flows into the body of the electric component unit (60) through the opening (66). While flowing downward, the air flowing into the body of the electric component unit (60) cools the control board (70) etc. provided in the electric component unit (60). Then, the air flowing through the electric component unit (60) flows out from the electric component unit (60) through the outlet part (62) of the bottom part of the electric component unit (60).

Due to a pressure difference between air at an entrance of the third inlet part (61*c*) and air at the exit of the outlet part (62), air on the outlet side of the outdoor fan (40) flows into the body of the electric component unit (60) through the third inlet part (61*c*). While flowing downward, the air cools the control board (70) etc. provided in the electric component unit (60). Then, the air flowing through the electric component unit (60) flows out from the electric component unit (60) through the outlet part (62) of the bottom part of the electric component unit (60).

Part of the air flowing to the outside of the electric component unit (60) through the outlet part (62) flows to the lower space (2*a*) through the cutout (29) of the left stay (20*d*), and the remaining part of the air flows to the lower space (2*a*) through the slits (28).

The air flowing out to the lower space (2*a*) is sucked into the outdoor fan (40). Then, the air flows upward, and is discharged to the outside of the casing (20).

Advantages of Second Embodiment

According to the second embodiment, since the left stay (20*d*) is provided, the bottom part of the electric component unit (60) can be supported. Thus, the electric component unit (60) can be stably held in the casing (20).

Since the outlet part (62) is formed in the bottom part of the electric component unit (60) and the slits (28) are formed in the left stay (20*d*), air flowing out through the outlet part (62) of the electric component unit (60) can be sent to the lower space (2*a*) of the casing (20) through the slits (28).

Since the cutout (29) is provided, the electric wire(s) extending from the electric component unit (60) can be drawn toward the lower space (2*a*). Thus, the electric component(s) of the element(s) placed below the outdoor fan (40) in the casing (20) can be connected to the electric component unit (60) through the wire(s).

Since the outlet part (62) of the electric component unit (60) and the slits (28) of the left stay (20*d*) are arranged such that the openings of the outlet part (62) and the openings of the slits (28) do not overlap with each other as viewed from the above, moisture is less likely to reach the inside of the electric component unit (60) even if the moisture flows from the lower space (2*a*) to the upper space (2*b*) through the slits (28).

Since the electric component unit (60) is configured to be drawable to the outside of the casing (20) and is formed in such a tapered shape that the electric component unit (60) becomes narrower from the front to the rear in a drawing direction, the electric component unit (60) can be easily drawn out from the casing (20). Thus, maintainability of the electric component unit (60) can be improved.

Since the electric component unit (60) is formed such that an inward-facing surface thereof is along the outer periphery of the bell mouth (43), the electric component unit (60) can be easily placed at the periphery of the bell mouth (43). A space can be formed below the bell mouth (43) in the casing (20), and therefore other element(s) can be arranged. Thus, the size of the outdoor unit (10) of the refrigerating apparatus can be reduced. Other configurations, features, and advantages of the second embodiment are similar to those of the first embodiment.

Third Embodiment of the Invention

Next, a third embodiment of the present disclosure will be described. The first and third embodiments are different from each other in a configuration of an electric component unit (60). Note that only differences from the first embodiment will be described in the third embodiment, and similarities will not be repeatedly described.

Figure 13:
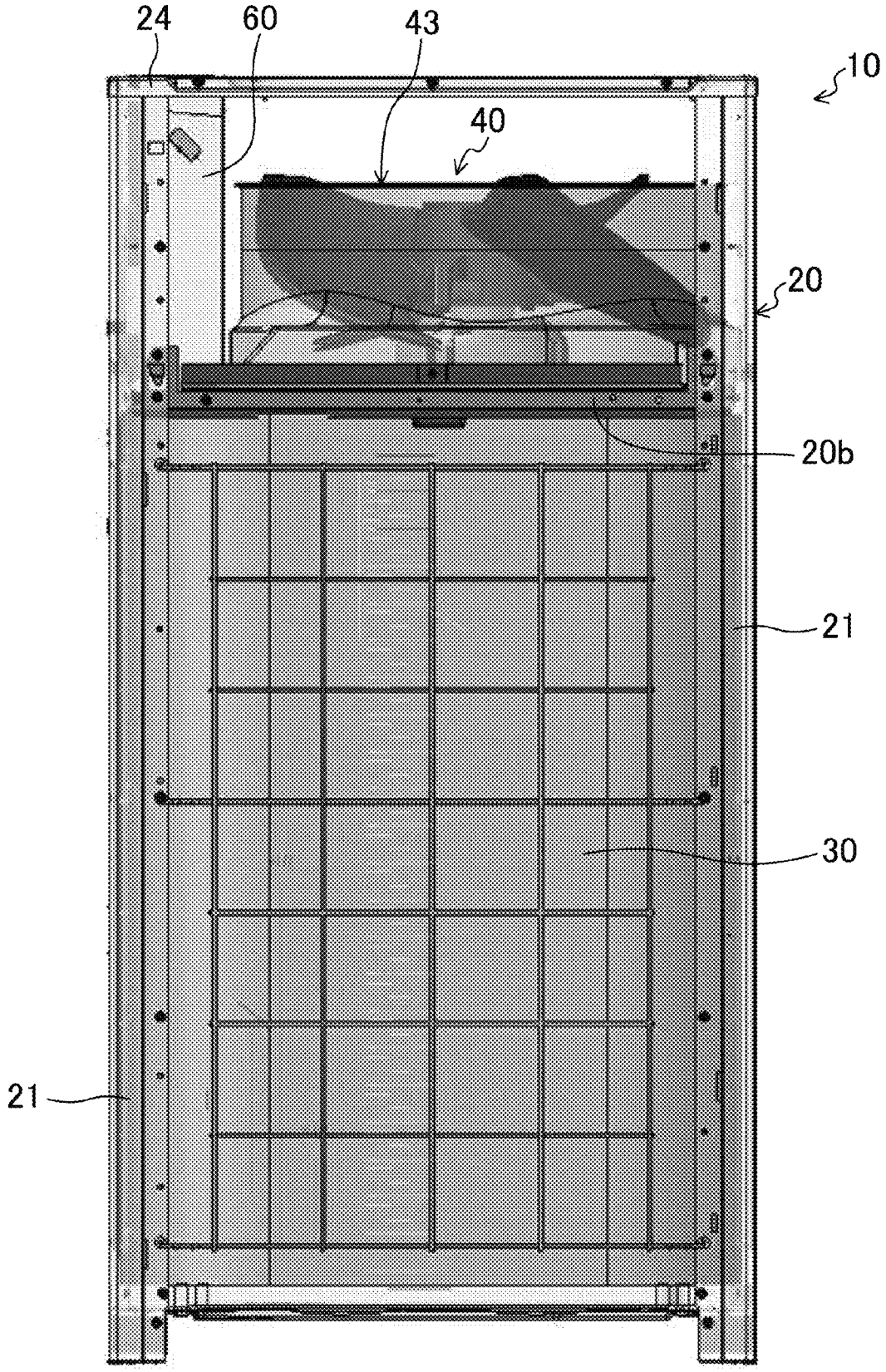
FIG. 13 is a right side view of an outdoor unit of a third embodiment.

Referring to FIG. 13, the electric component unit (60) in which, e.g., an electric component configured to control a compression mechanism (50) etc. is accommodated is attached to a casing (20). The electric component unit (60) is arranged above a front part of an outdoor heat exchanger (30) in proximity to an upper end of the outdoor heat exchanger (30). Moreover, the electric component unit (60) is provided between an upper side panel (23*a*) and each of bell mouths (43) of outdoor fans (40). A top panel (24) of the casing (20) is arranged right above the electric component unit (60). Further, the electric component unit (60) is arranged at such a position that a lower end part of the electric component unit (60) is placed above the outdoor heat exchanger (30) and that part of the electric component unit (60) overlaps with the bell mouths (43) in a height direction. The electric component unit (60) is formed so as to have a height larger than that of the bell mouth (43).

Figure 14:
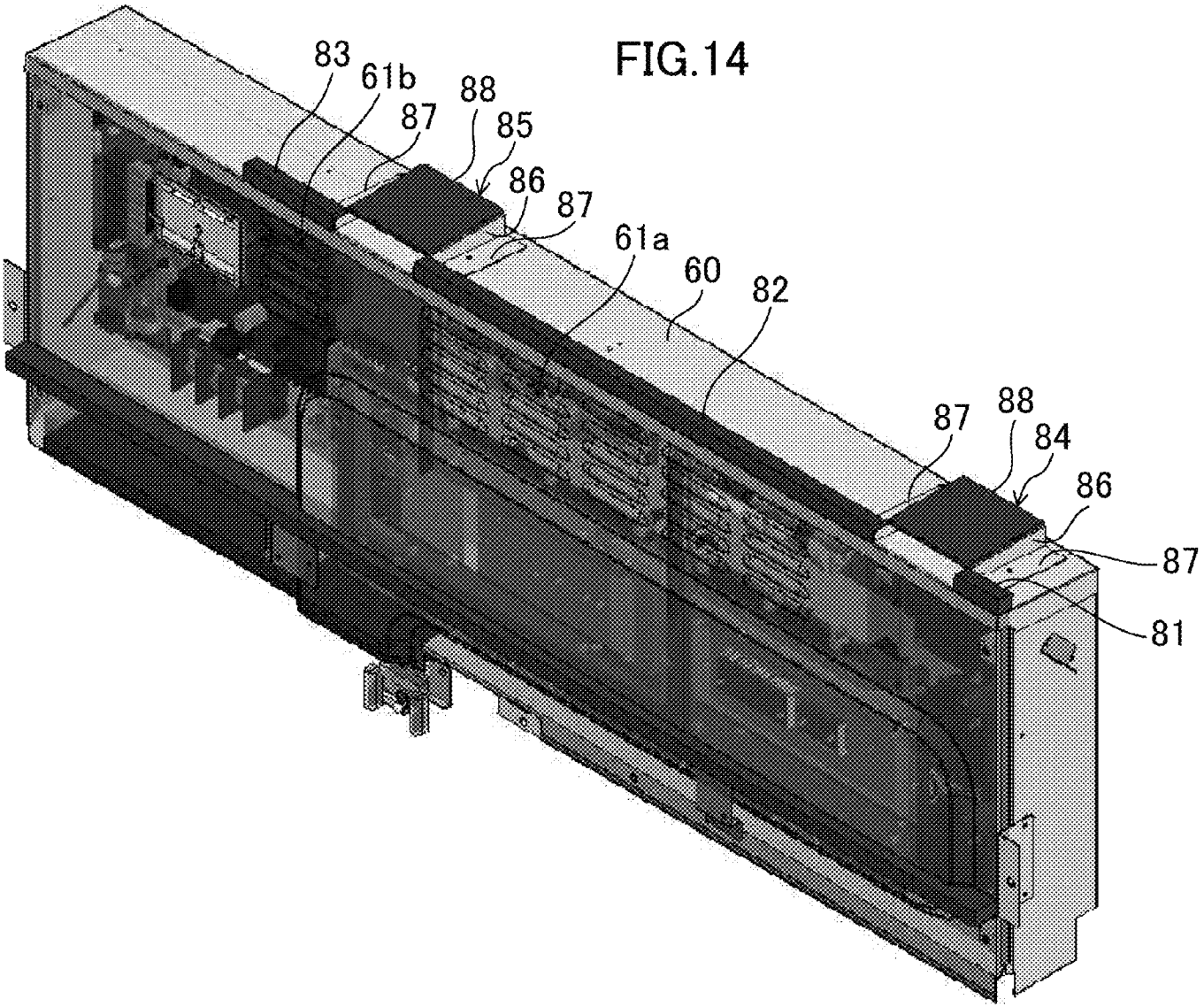
FIG. 14 is a view of an internal structure of an electric component unit of the third embodiment.
Figure 15:
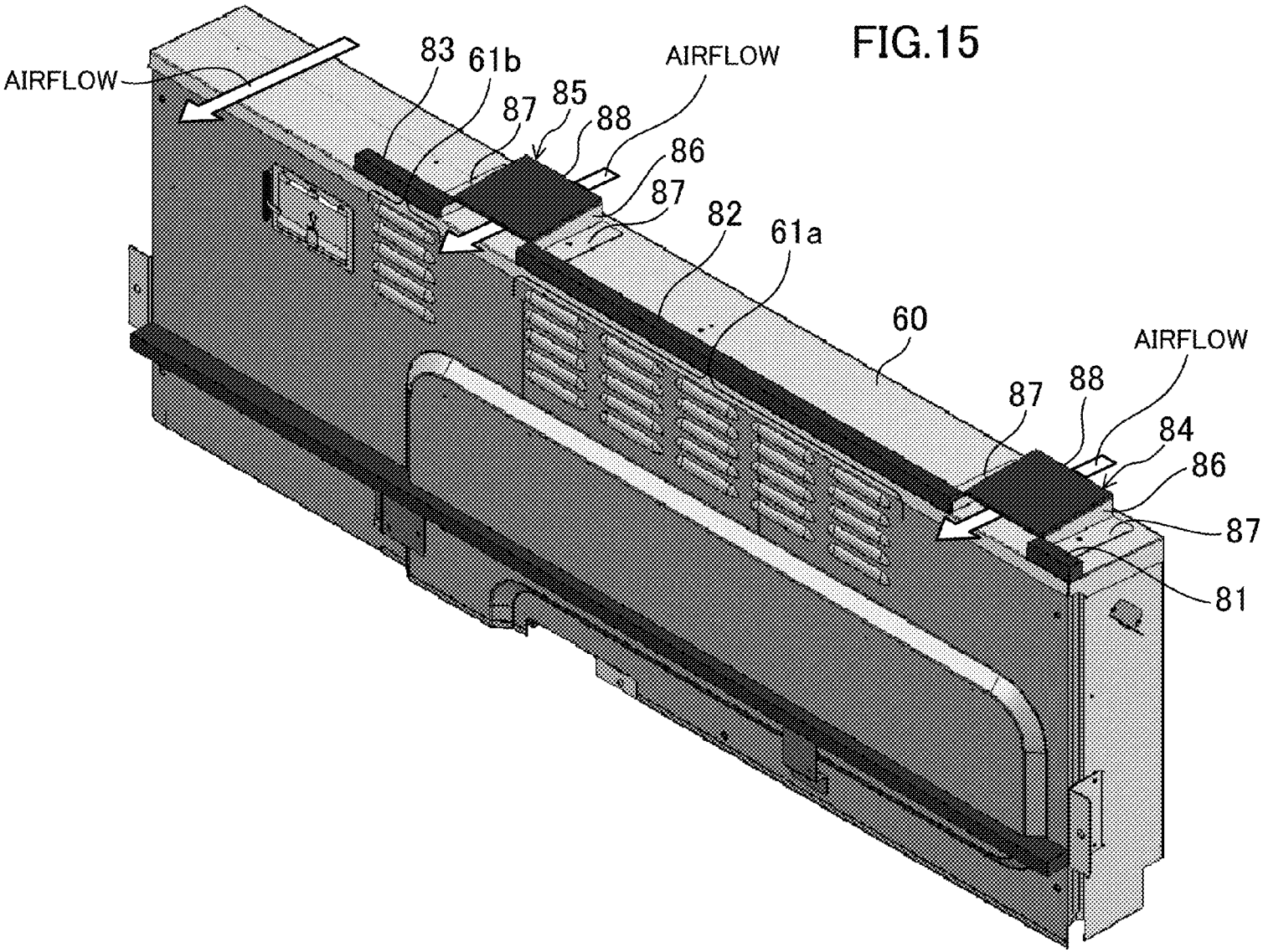
FIG. 15 is a perspective view of the electric component unit of the third embodiment.
Figure 16:
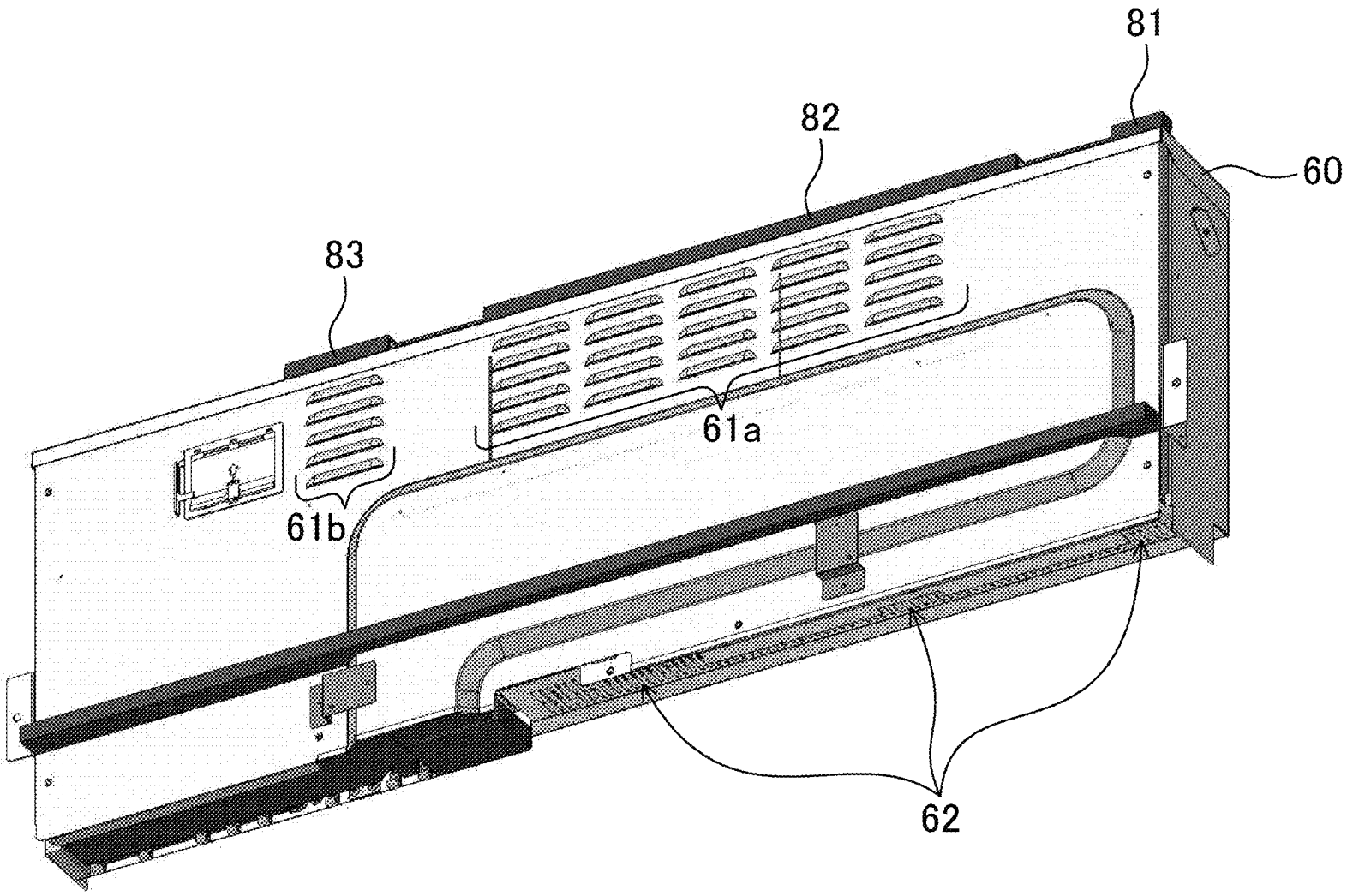
FIG. 16 is a perspective view of the electric component unit of the third embodiment from under the electric component unit.

Referring to FIGS. 14-16, the electric component unit (60) is a box formed in a substantially rectangular flat plate shape, and is attached to the casing (20) in the state in which the electric component unit (60) is upwardly supported by a front stay (20*a*). Although not shown in the figure, legs are provided respectively at four corners of a bottom part of the electric component unit (60), and the bottom part of the electric component unit (60) is arranged slightly apart from a surface of the front stay (20*a*).

In the electric component unit (60), first and second inlet parts (61*a*, 61*b*) through each of which air is taken into the electric component unit (60) and an outlet part (62) through which air is discharged to the outside of the electric component unit (60) are provided. Specifically, a plurality of slits are formed in each of the first and second inlet parts (61*a*, 61*b*), and the first and second inlet parts (61*a*, 61*b*) are formed in a substantially upper part of a front surface of the electric component unit (60) as viewed in FIG. 15. The first inlet part (61*a*) is formed with the slits arranged in five columns, and is provided at a right part of the electric component unit (60). The second inlet part (61*b*) is formed with the slits arranged in a single column, and is provided at a left part of the electric component unit (60).

Openings through each of which air circulates are formed in the outlet part (62), and are formed close to the right (a first end of the electric component unit (60) in a longitudinal direction thereof) in a bottom part of the electric component unit (60). The outlet part (62) opens to an internal space of the electric component unit (60), and opens to a left stay (20*d*) in the state in which the electric component unit (60) is placed in the casing (20).

On an upper surface of the electric component unit (60), first to third end part seals (81, 82, 83) and first and second contact members (84, 85) are provided.

The first and second contact members (84, 85) are members each configured to prevent the top panel (24) and the electric component unit (60) from contacting each other due to, e.g., vibration. Each of the first and second contact members (84, 85) is formed in a substantially U-shape as viewed in a cross section. Moreover, each of the first and second contact members (84, 85) includes a body (86) formed with a substantially-rectangular upper surface, and two flanges (87) each extending, in the horizontal direction, from a corresponding one of end parts of the body (86).

The first contact member (84) is provided close to the right on the upper surface of the electric component unit (60) so as to correspond to a region where the first inlet part (61*a*) is not provided.

The second contact member (85) is provided close to the left on the upper surface of the electric component unit (60) so as to correspond to a region where the first inlet part (61*a*) and the second inlet part (61*b*) are not provided.

The first and second contact members (84, 85) are each arranged such that a longitudinal direction of the flange (87) is along a width direction of the electric component unit (60). A sealant sheet member (88) formed in a substantially rectangular planar shape is provided on an upper surface of the body (86) of each of the first and second contact members (84, 85). The first and second contact members (84, 85) each contact the top panel (24) of the casing (20) with the sealant sheet member (88) being interposed therebetween. Thus, noise (contact noise) caused due to direct contact between the top panel (24) and the electric component unit (60) can be reduced or prevented.

An air passage is formed between an inner surface of the body (86) of each of the first and second contact members (84, 85) and the upper surface of the electric component unit (60). Air on an outlet side of the outdoor fan (40) passes through the air passage, and then flows into a space in the front of the electric component unit (60).

The first to third end part seals (81, 82, 83) are each configured to prevent water from entering the first and second inlet parts (61*a*, 61*b*). Each of the first to third end part seals (81, 82, 83) is a sealing piece formed in a substantially L-shape as viewed in a cross section. The first to third end part seals (81, 82, 83) are each provided along a front end part of the electric component unit (60) on the upper surface thereof. Each of the first to third end part seals (81, 82, 83) is arranged so as to contact the top panel (24) at an upper surface (one side of the L-shape) thereof.

Specifically, the first end part seal (81) is formed in dimensions corresponding to part of the electric component unit (60) between a right end part of the electric component unit (60) and the first contact member (84). The second end part seal (82) is formed in dimensions corresponding to an area where the first inlet part (61*a*) is formed, and is provided right above the first inlet part (61*a*). The third end part seal (83) is formed in dimensions corresponding to an area where the second inlet part (61*b*) is formed, and is provided right above the second inlet part (61*b*).

For example, a control board (70) configured to control a compressor (5*a*) etc. is accommodated in the electric component unit (60).

Airflow in Electric Component Unit

During operation of an outdoor unit (10), the outdoor fans (40) are operated to form an airflow inside the electric component unit (60).

Figure 17:
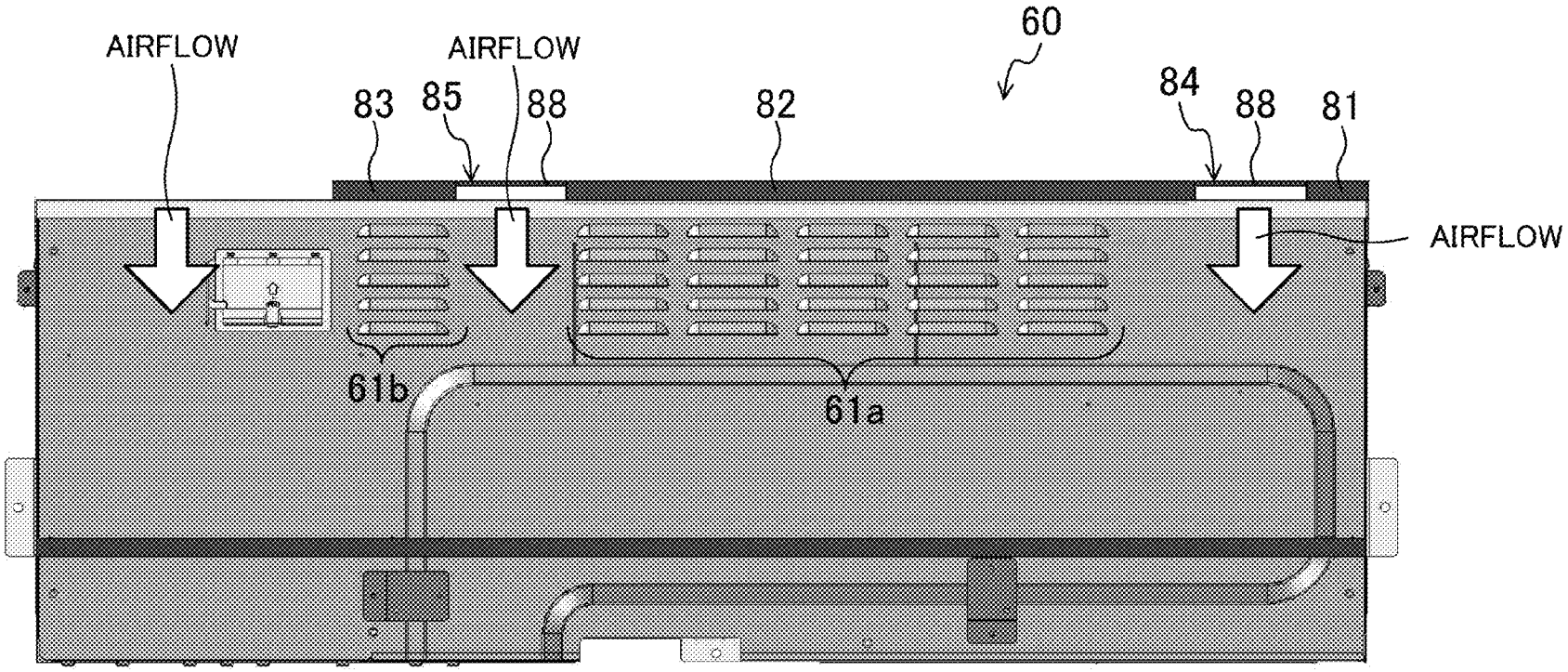
FIG. 17 is a front view of the electric component unit of the third embodiment.
Figure 18:
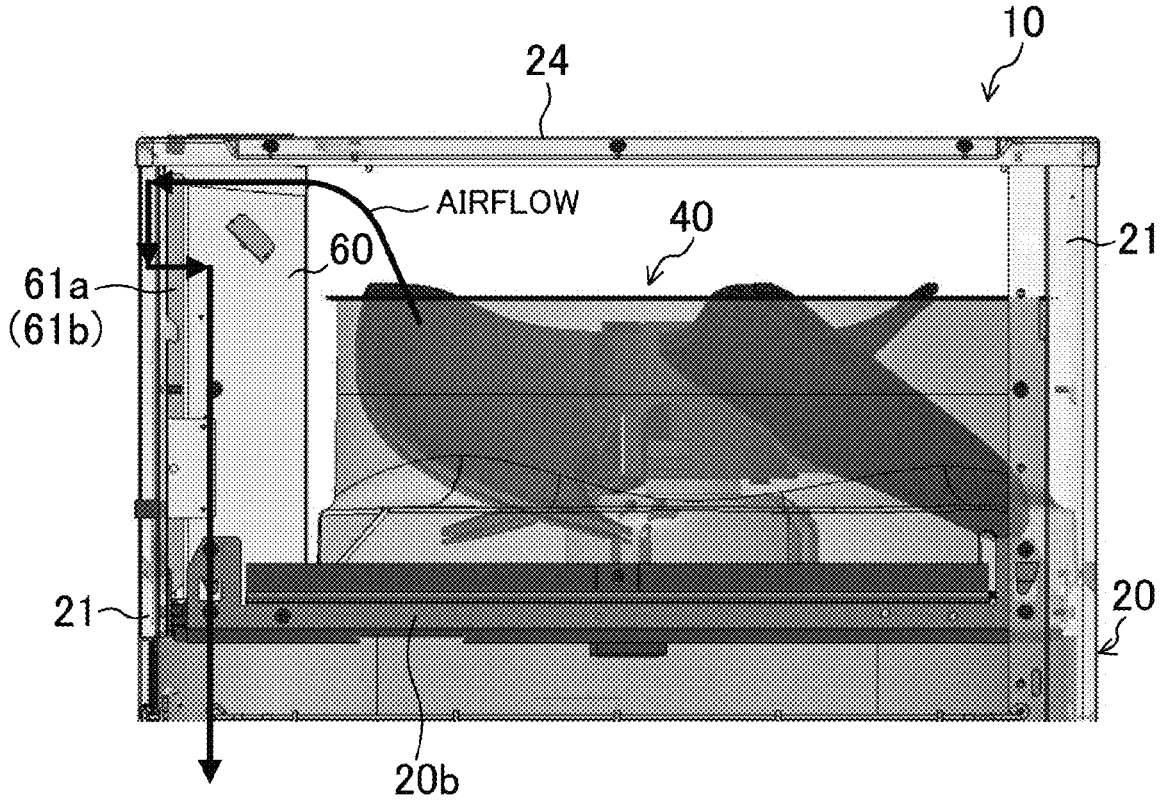
FIG. 18 is a view illustrating an airflow in the outdoor unit of the third embodiment.

Specifically, the operation of the outdoor fans (40) causes, referring to FIGS. 17 and 18, the pressure of air on the outlet side of the outdoor fan (40) in the upper space (2*b*) to be positive pressure higher than atmospheric pressure, and, on the other hand, causes the pressure of air in the lower space (2*a*) to be negative pressure lower than the atmospheric pressure.

Due to a pressure difference between air at entrances of the first and second inlet parts (61*a*, 61*b*) of the electric component unit (60) and air at an exit of the outlet part (62) of the electric component unit (60), air on the outlet side of the outdoor fan (40) flows, referring to FIG. 15, from the rear to the front of the electric component unit (60) through the air passages of the first and second contact members (84, 85) and the left part of the upper surface of the electric component unit (60). The air flowing to the front side of the electric component unit (60) flows along the front surface of the electric component unit (60), and then flows into the electric component unit (60) through the first and second inlet parts (61*a*, 61*b*). While flowing downward, the air flowing into the electric component unit (60) cools the control board (70) etc. provided in the electric component unit (60). Then, the air flowing through the electric component unit (60) flows out from the electric component unit (60) through the outlet part (62) of the bottom part of the electric component unit (60).

Next, part of the air flowing to the outside of the electric component unit (60) through the outlet part (62) flows to the lower space (2*a*) through the cutout (29) of the front stay (20*a*), and the remaining part of the air flows to the lower space (2*a*) through the slits (28).

The air flowing out to the lower space (2*a*) is sucked into the outdoor fans (40). Then, the air flows upward, and is discharged to the outside of the casing (20). Other configurations, features, and advantages of the third embodiment are similar to those of the first embodiment.

Other Embodiment

The present disclosure may have the following configuration for the first embodiment.

When the electric component unit (60) is attached to the casing (20), the electric component unit (60) may be attached from the above by sliding along the right and left supports (21).

The present disclosure may have the following configurations for the first to third embodiments.

In the first and third embodiments, the electric component unit (60) is upwardly supported by the front stay (20*a*). However, the present disclosure is not limited to such a configuration. A hole may be formed in the front stay (20*a*), and the electric component unit (60) may be held by the front stay (20*a*) with a lower part of the electric component unit (60) being inserted into the hole. In such a case, the electric component unit (60) is held in the state in which the lower end part thereof downwardly protrudes from the front stay (20*a*).

In the second embodiment, the electric component unit (60) is upwardly supported by the left stay (20*d*). However, the present disclosure is not limited to such a configuration. A hole may be formed in the left stay (20*d*), and the electric component unit (60) may be held by the left stay (20*d*) with the lower part of the electric component unit (60) being inserted into the hole. In such a case, the electric component unit (60) is held in the state in which the lower end part thereof downwardly protrudes from the left stay (20*d*).

In the first to third embodiments, the inside of the casing (20) is divided into the upper space (2*b*) and the lower space (2*a*) by the stays (20*a*-20*d*), the bell mouth(s) (43), and the electric component unit (60). However, the present disclosure is not limited to such a configuration. The inside of the casing (20) may be divided into the upper space (2*b*) and the lower space (2*a*) only by the bell mouth(s) (43).

In the first to third embodiments, the refrigerant pipe(s) cools, e.g., the control board (70) and the heat sink in contact therewith. However, the present disclosure is not limited to such a configuration. The heat sink may be cooled in contact with an electric component such as the control board (70).

In the first to third embodiments, the electric component unit (60) is upwardly supported by the stay (20*a*, 20*d*). However, the present disclosure is not limited to such a configuration. The electric component unit (60) may be fixed to the supports (21).

Note that the foregoing embodiments have been set forth merely for the purpose of preferred examples in nature, and are not intended to limit the scope, applications, and use of the invention.

INDUSTRIAL APPLICABILITY

As described above, the present disclosure is useful for the outdoor unit of the refrigerating apparatus.

DESCRIPTION OF REFERENCE CHARACTERS

2*a* Lower Space
2*b* Upper Space
20 Casing
20*a* Front Stay
20*d* Left Stay
25 Inlet Port
28 Slit
29 Cutout
30 Outdoor Heat Exchanger
40 Outdoor Fan
41 Fan Body
43 Bell Mouth
60 Electric Component Unit
61 Inlet Part

61*a* First Inlet Part
61*b* Second Inlet Part
62 Outlet Part

The invention claimed is:

1. An outdoor unit of a refrigerating apparatus, comprising:

a casing in which an outdoor heat exchanger, an air blower configured to blow air to an outside of the casing, and an electric component unit in which an electric component is accommodated are arranged, wherein an inside of the casing is divided into (i) a first chamber in which the air blower is arranged, and which is provided to an outlet side of the blower and has pressure higher than atmospheric pressure when the blower operates, and (ii) a second chamber in which the outdoor heat exchanger is arranged, and which is provided to an inlet side of the blower and has pressure lower than the atmospheric pressure when the blower operates, the electric component unit includes an inlet part through which air flows into the electric component unit, and an outlet part through which air flows out from the electric component unit, and the electric component is arranged in the first chamber such that the inlet part communicates with the first chamber and the outlet part communicates with the second chamber.

2. The outdoor unit of claim 1, wherein the casing has a side surface formed with an air inlet port, and the outdoor heat exchanger is arranged so as to face the air inlet port, the air blower includes a fan and a bell mouth provided so as to surround an outer periphery of the fan, and is arranged above the air inlet port in the casing such that air is blown upward, and the electric component unit positioned at a periphery of the bell mouth is arranged in the casing.

3. The outdoor unit of claim 2, wherein the electric component unit is arranged at a position at which at least part of the electric component unit overlaps with the bell mouth in a height direction and a lower end part of the electric component unit is above the outdoor heat exchanger.

4. The outdoor unit of claim 2, wherein in the casing, a stay configured to support a bottom part of the electric component unit is provided between the first chamber which is formed on an upper side inside the casing and the second chamber which is formed on a lower side inside the casing.

5. The outdoor unit of claim 4, wherein the outlet part is formed in the bottom part of the electric component unit, and an air port configured to guide air flowing out through the outlet part to the second chamber is formed in the stay.

6. The outdoor unit of claim 4, wherein a wire opening through which an electric wire extending from the electric component unit passes is formed in the stay.

7. The outdoor unit of claim 5, wherein the outlet part of the electric component unit and the air port of the stay are arranged so as to be displaced from each other in a horizontal direction.

8. The outdoor unit of claim 4, wherein the electric component unit is configured to be drawable to an outside of the casing, and an outer shape of the electric component unit is a tapered shape in which the electric component unit becomes narrower from a front to a rear in a drawing direction.

9. The outdoor unit of claim 4, wherein the electric component unit is formed such that an inwardly-facing surface thereof is along an outer periphery of the bell mouth.

* * * * *